US007719490B2

(12) United States Patent
Shim et al.

(10) Patent No.: US 7,719,490 B2
(45) Date of Patent: May 18, 2010

(54) PLASMA DISPLAY APPARATUS

(75) Inventors: Kyung Ryeol Shim, Gumi-si (KR); Seong Hoon An, Busan (KR); Myung Soo Ham, Gumi (KR)

(73) Assignee: LG Electronics Inc., Seoul (KR)

( * ) Notice: Subject to any disclaimer, the term of this patent is extended or adjusted under 35 U.S.C. 154(b) by 951 days.

(21) Appl. No.: 11/365,934

(22) Filed: Mar. 2, 2006

(65) Prior Publication Data

US 2007/0040767 A1 Feb. 22, 2007

(30) Foreign Application Priority Data

Aug. 17, 2005 (KR) ..... 10-2005-0075453
Aug. 17, 2005 (KR) ..... 10-2005-0075454

(51) Int. Cl.
*G09G 3/28* (2006.01)

(52) U.S. Cl. ..... 345/68

(58) Field of Classification Search ..... 346/60; 345/60, 68

See application file for complete search history.

(56) References Cited

U.S. PATENT DOCUMENTS 6,184,848 B1 * 2/2001 Weber ..... 345/60
6,483,250 B1 * 11/2002 Hashimoto et al. ..... 345/60
6,590,345 B2 * 7/2003 Myoung et al. ..... 315/169.1
6,653,795 B2 * 11/2003 Kang et al. ..... 345/60
6,677,920 B2 * 1/2004 Huang et al. ..... 345/60
6,903,514 B2 * 6/2005 Yun et al. ..... 345/60
2002/0158822 A1 * 10/2002 Ishizuka et al. ..... 345/63
2002/0186184 A1 * 12/2002 Lim ..... 345/60
2005/0093853 A1 * 5/2005 Kim ..... 345/210
2006/0170620 A1 * 8/2006 Han ..... 345/67

FOREIGN PATENT DOCUMENTS

EP 1 708 159 A2 10/2006
EP 1 717 786 A2 11/2006
KR 10-2005-0089580 A 9/2005

OTHER PUBLICATIONS

European Search Report dated Aug. 31, 2007.

* cited by examiner

*Primary Examiner*—Richard Hjerpe
*Assistant Examiner*—Dorothy Webb
(74) *Attorney, Agent, or Firm*—KED & Associates, LLP

(57) ABSTRACT

An apparatus for driving a PDP is capable of controlling a scan reference voltage when set up pulses are supplied to scan electrodes Y1 to Ym in a set up period of a reset period and when the scan reference voltage is supplied to the scan electrodes in an address period to reduce the generation of noise. The apparatus for driving the PDP comprises scan electrodes, a scan reference voltage supply comprising a resistance for applying a scan rising waveform that rises to a scan reference voltage with a second slope to the scan electrodes after a rising ramp waveform and a falling ramp waveform having a first slope have been applied to the scan electrodes, and a negative scan voltage supply for applying a negative scan pulse that falls from the scan reference voltage applied by the scan reference voltage supply to the scan electrodes.

20 Claims, 19 Drawing Sheets

PLASMA DISPLAY APPARATUS

The present invention relates to a plasma display panel (PDP). It more particularly relates to an apparatus for driving a PDP capable of controlling a scan reference voltage when set up pulses are supplied to scan electrodes Y1 to Ym in the set up period of a reset period and when a scan reference voltage is supplied to the scan electrodes in an address period to reduce the generation of noise.

A conventional plasma display apparatus comprises a plasma display panel (PDP) in which a barrier rib formed between a top surface substrate and a bottom surface substrate forms a unit cell. A main discharge gas such as Ne, He, and Ne+He and an inert gas comprising a small amount of xenon fill each cell. When a discharge is generated by a high frequency voltage, the inert gas generates vacuum ultraviolet (UV) radiation and causes a phosphor formed between the barrier ribs to emit visible light to realize an image. Since the plasma display apparatus can be made thin and light, the plasma display apparatus is spotlighted as a next generation display apparatus.

FIG. 1 illustrates the structure of a common PDP.

As illustrated in FIG. 1, according to the PDP, a top surface substrate 100 obtained by arranging a plurality of pairs of electrodes formed of scan electrodes Y1 to Ym 102 and sustain electrodes 103 that make pairs on a top surface glass 101 that is a display surface on which images are displayed and a bottom surface substrate 110 obtained by arranging a plurality of address electrodes 113 on a bottom surface glass 111 that forms the back surface so as to intersect the plurality of pairs of sustain electrodes are combined with each other to run parallel to each other by a uniform distance.

The top surface substrate 100 comprises the scan electrodes Y1 to Ym 102 and the sustain electrodes 103 for discharging each other in one discharge cell to sustain emission of the cell, that is, the scan electrodes Y1 to Ym 102 and the sustain electrodes 103 that comprise transparent electrodes a formed of transparent indium tin oxide (ITO) and bus electrodes b formed of metal and that make pairs. The scan electrodes Y1 to Ym 102 and the sustain electrodes 103 are covered with one or more dielectric layers 104 for restricting the discharge current of the scan electrodes 102 and the sustain electrodes 103 to insulate the pairs of electrodes from each other. A protective layer 105 on which MgO is deposited is formed on the entire surface of the dielectric layer 104 in order to facilitate discharge.

Stripe type (or well type) barrier ribs 112 for forming a plurality of discharge spaces, that is, discharge cells are arranged on the bottom surface substrate 110 to run parallel to each other. Also, the plurality of address electrodes 113 that perform address discharge to generate the vacuum UV radiation are arranged to run parallel with respect to the barrier ribs 112. The bottom surface substrate 110 is coated with the R, G, and B phosphors 114 that emit visible light to display images during the address discharge. A lower dielectric layer 115 for protecting the address electrodes 113 is formed between the address electrodes 113 and the phosphors 114.

A method of realizing gray levels of the PDP having such a structure will be described with reference to FIG. 2 as follows.

FIG. 2 illustrates a conventional method of realizing gray levels of a PDP.

As illustrated in FIG. 2, according to the conventional method of realizing the gray levels of the PDP, one frame period is divided into a plurality of sub-fields having different durations of emission and each sub-field is divided into a reset period RPD for initializing all of the cells, an address period APD for selecting a cell to be discharged, and a sustain period SPD for realizing gray levels in accordance with the durations of discharge. For example, when an image is to be displayed by 256 gray levels, a frame period (16.67 ms) corresponding to 1/60 second is divided into eight sub-fields SF1 to SF8 as illustrated in FIG. 2 and each of the eight sub-fields SF1 to SF8 is divided into the reset period, the address period, and the sustain period.

The reset period and the address period are the same in each of the sub-fields. The address discharge for selecting the cell to be discharged is generated by difference in voltage between the address electrodes and the transparent electrodes that are the scan electrodes Y1 to Ym. Here, the sustain period in each sub-field increases in the ratio of 2n (n=0. 1. 2. 3. 4. 5. 6, and 7). As described above, since the sustain period varies with each sub-field, it is possible to realize gray levels of an image by controlling the sustain period of each sub-field, that is, the number of times sustain discharge takes place.

A conventional method of driving the PDP according to the common method of realizing the gray levels will be described with reference to FIG. 3.

FIG. 3 illustrates driving waveforms generated by a conventional apparatus for driving the PDP.

As illustrated in FIG. 3, the PDP is driven such that each sub-field is divided into a reset period for initializing all of the cells, an address period for selecting a cell to be discharged, a sustain period for sustaining the discharge of the selected cell, and an erase period for erasing wall charges in the discharged cell.

In the set up period of the reset period, a rising ramp waveform Ramp-up is simultaneously applied to all of the scan electrodes Y1 to Ym. Dark discharge is generated in the discharge cells of the entire screen due to the rising ramp waveform. Positive wall charges are accumulated on the address electrodes and the sustain electrodes and negative wall charges are accumulated on the scan electrodes Y1 to Ym due to the set up discharge.

In the set down period of the reset period, after the rising ramp waveform is supplied, a falling ramp waveform Ramp-down that starts to fall from a positive voltage lower than the peak voltage of the rising ramp waveform and to thus fall to a specific voltage level no more than a ground GND level generates weak erase discharge in the cells to erase the wall charges excessively formed in the scan electrodes Y1 to Ym. The wall charges to the amount that can stably generate the address discharge uniformly reside in the cells due to the set down discharge.

In the address period, a negative scan pulse is sequentially applied to the scan electrodes Y1 to Ym and, at the same time, a positive data pulse is applied to the address electrodes in synchronization with the scan pulse. When difference in voltage between the scan pulse and the data pulse is added to the wall voltage generated in the reset period, an address discharge is generated in the discharge cell to which the data pulse is applied. Wall charges to the amount that can generate discharge when the sustain voltage Vs is applied are formed in the cells selected by the address discharge. A positive bias voltage Vz is supplied to the sustain electrodes in the set down period and the address period so that difference in voltage between the scan electrodes Y1 to Ym and the sustain electrodes is reduced to prevent erroneous discharge from being generated between the scan electrodes Y1 to Ym and the sustain electrodes.

In the sustain period, sustain pulses sus are alternately applied to the scan electrodes Y1 to Ym and the sustain electrodes. In the cells selected by the address discharge, the wall voltage in the cells is added to the sustain pulse so that the sustain discharge, that is, display discharge is generated between the scan electrodes Y1 to Ym and the sustain electrodes whenever each sustain pulse is applied.

After the sustain discharge is completed, a voltage of an erase ramp waveform Ramp-ers having small pulse width and voltage level is supplied to the sustain electrodes in the erase period to erase the wall charges that reside in the cells of the entire screen.

A conventional apparatus for driving a PDP for generating the driving waveforms will be described with reference to FIG. 4.

FIG. 4 illustrates a conventional apparatus for driving the PDP.

Referring to FIG. 4, the conventional apparatus for driving the PDP comprises an energy recovery circuit 300, a drive integrated circuit 350, a set up supply 310, a set down supply 330, a negative scan voltage supply 320, a scan reference voltage supply 340, a seventh switch Q7 connected between the set up supply 310 and the drive integrated circuit 350, and a sixth switch Q6 connected between the set up supply 310 and the energy recovery circuit 300.

The drive integrated circuit 350 is connected in push/pull configuration and comprises 12th and 13th switches Q12 and Q13 to which voltage signals are input from the energy recovery circuit 300, the set up supply 310, the set down supply 330, the negative scan voltage supply 320, and the scan reference voltage supply 340. An output line between the 12th and 13th switches Q12 and Q13 is connected to one of the scan electrode lines Y1 to Ym of a panel Cp.

The energy recovery circuit 300 recovers energy from the panel Cp and supplies a sustain voltage Vs to the panel Cp.

The negative scan voltage supply 320 supplies scan pulses Sp having a voltage magnitude of −Vy to the scan electrode lines Y1 to Ym in the address period.

The scan reference voltage supply 340 supplies a scan reference voltage Vsc to the scan electrode lines Y1 to Ym in the address period.

The set down supply 330 supplies falling ramp pulses to the scan electrode lines Y1 to Ym in the set down period of the reset period.

The set up supply 310 supplies rising ramp pulses Ramp-Up to the scan electrode lines Y1 to Ym in the set up period of the reset period.

In the conventional apparatus for driving the PDP, a field effect transistor (FET) is used as a switching device. Since the FET is expensive, the manufacturing cost of the apparatus for driving the PDP increases. Therefore, since a large number of FETs are used for the conventional apparatus for driving the PDP of FIG. 4, the manufacturing cost of the conventional apparatus for driving the PDP increases.

Also, since the difference in voltages applied to a first node n1 and a second node n2 is large in the conventional apparatus for driving the PDP, a seventh switch Q7 having a high withstand voltage has to be used, which increases the manufacturing cost of the conventional apparatus for driving the PDP.

Here, the seventh switch Q7 comprises an internal diode whose polarity is different from the direction of the internal diode of the sixth switch Q6 to prevent the voltage applied to the second node n2 from being supplied to a ground level GND via the internal diode of the sixth switch Q6 and the internal diode of the fourth switch Q4. On the other hand, a voltage of Vs is applied to the first node n1 and the voltage −Vy of the scan pulses Sp is applied to the second node n2 in the set down period. Here, when the voltage of Vs is set to about 180V and the voltage −Vy of the scan pulses is set to about −70V, the seventh switch Q7 needs to have a withstand voltage of about 250V (about 300V in consideration of actual driving voltage margin). That is, in the prior art, since a switching device having a high withstand voltage must be used as the seventh switch Q7, manufacturing cost increases.

Also, since the reset voltage and the sustain voltage pass through the sixth and seventh switches Q6 and Q7, the sixth and seventh switches Q6 and Q7 must have high withstand voltages no less than the reset voltage that applies the set up waveforms. Therefore, cost increases and heat generation and energy loss are large.

Also, the conventional apparatus for driving the PDP supplies the set up pulses of a high voltage, for example, the set up pulses having a voltage of the sum of the sustain voltage Vs and the set up voltage Vsetup to the san electrodes Y1 to Ym (Y) in the reset period so that contrast deteriorates in the reset period.

Also, the conventional apparatus for driving the PDP supplies the scan reference voltage Vsc that rapidly increases at the same point of time to the scan electrodes Y1 to Ym (Y) in the address period after the above-described reset period, which will be described with reference to FIG. 5.

FIG. 5 illustrates the scan reference voltage supplied by the conventional apparatus for driving the PDP in the address period.

As illustrated in FIG. 5, the conventional apparatus for driving the PDP supplies the scan reference voltage Vsc that rapidly rises in all of the scan electrodes Y1 to Ym at the same point of time ts to the scan electrodes Y1 to Ym in the address period. When the scan reference voltage Vsc is supplied to the scan electrodes Y1 to Ym at the same point of time ts, noise is generated in the waveforms of the scan reference voltage Vsc supplied to the scan electrodes Y1 to Ym. An example in which the noise is generated when the scan reference voltage is applied to the scan electrodes Y1 to Ym at the same point of time will be described with reference to FIG. 6.

FIG. 6 illustrates the noise generated by the scan reference voltage supplied to the scan electrodes Y1 to Ym by the conventional apparatus for driving the PDP in the address period.

As illustrated in FIG. 6, when the conventional apparatus for driving the PDP supplies the scan reference voltage Vsc that rapidly rises at the same point of time ts to the scan electrodes Y1 to Ym in the address period, the noise is generated in the driving waveforms applied to the scan electrodes Y1 to Ym. The noise is generated by capacitive coupling. At the point where the scan reference voltage rapidly rises, the rising noise is generated in the driving waveforms applied to the scan electrodes Y1 to Ym.

As described above, the noise generated in the driving waveforms applied to the scan electrodes Y1 to Ym due to the same point of time at which the scan reference voltage Vsc is applied to the scan electrodes Y1 to Ym makes the driving of the PDP unstable, so as to reduce driving margin.

The present invention seeks to provide an improved plasma display panel.

Embodiments of the present invention can provide an apparatus for driving a plasma display panel (PDP) capable of reducing manufacturing cost by reducing the number of field effect transistors (FET) used for the apparatus for driving the PDP and of reducing the magnitude of dark discharge generated in a reset period.

Embodiments of the present invention can provide a plasma display apparatus capable of reducing noise of driving waveforms supplied to scan electrodes Y1 to Ym in an address period to stabilize driving of the plasma display apparatus and to thus improve driving efficiency.

Embodiments of a plasma display apparatus in accordance with the invention can make it possible to reduce the generation of noise so that driving efficiency is improved and to prevent circuit devices from being electrically damaged so that manufacturing cost is reduced.

In accordance with a first aspect of the invention a plasma display apparatus comprises scan electrodes, a scan reference voltage supply comprising a resistance and arranged to apply a scan rising waveform that rises to a scan reference voltage with a second slope to the scan electrodes after a rising ramp waveform and a falling ramp waveform having a first slope are applied to the scan electrodes, and a negative scan voltage supply arranged to apply a negative scan pulse that falls from the scan reference voltage applied by the scan reference voltage supply to the scan electrodes.

The resistance may be a fixed resistance or a variable resistance.

The scan reference voltage supply may apply the scan rising waveform to the scan electrodes and then, apply the scan reference voltage to the scan electrodes.

The plasma display apparatus may further comprise a ramp waveform generator for generating a rising ramp waveform having a third slope different from the first slope of the rising ramp waveform.

The second slope of the scan rising waveform may be smaller than the slope of a sustain pulse applied in a sustain period.

The scan reference voltage supply may comprise a capacitor for sustaining the scan reference voltage uniform.

The ramp waveform generator may comprise a resistance for generating the rising ramp waveform having the third slope.

In accordance with another aspect of the invention a plasma display apparatus comprises scan electrodes, a scan reference voltage supply comprising a resistance and arranged to apply a scan rising waveform that rises to a scan reference voltage with a second slope to the scan electrodes after applying a rising ramp waveform having a first slope to the scan electrodes, and a ramp waveform generator arranged to generate a rising ramp waveform having a third slope different from the first slope of the rising ramp waveform supplied by the scan reference voltage supply.

The resistance may be a fixed resistance or a variable resistance.

The scan reference voltage supply may apply the scan rising waveform having the second slope to the scan electrodes and then, apply a scan reference voltage to the scan electrodes.

The second slope of the scan rising waveform may be smaller than the slope of a sustain pulse applied in a sustain period.

The scan reference voltage supply may comprise a capacitor for sustaining the scan reference voltage uniform.

The ramp waveform generator may comprise a resistance for generating the rising ramp waveform having the third slope.

The scan reference voltage supply may comprise a reverse current intercepting unit.

The resistance may be a variable resistance.

In accordance with another aspect of the invention, a plasma display apparatus comprises scan electrodes, a scan reference voltage supply comprising a first resistance and arranged to apply a scan rising waveform that rises to a scan reference voltage with a second slope to the scan electrodes after applying a rising ramp waveform having a first slope to the scan electrodes, and a second resistance arranged to generate a rising ramp waveform having a third slope different from the first slope of the rising ramp waveform supplied by the scan reference voltage supply.

The first and second resistances may be of fixed resistance or variable resistance.

The scan reference voltage supply may apply the scan rising waveform having the second slope to the scan electrodes and then, apply the scan reference voltage to the scan electrodes.

The second slope may be smaller than the slope of the sustain pulse applied in the sustain period.

The scan reference voltage supply may comprise a capacitor for sustaining the scan reference voltage uniform.

Embodiments of the invention will now be described by way of non-limiting example only, with reference to the drawings.

Figure 1:
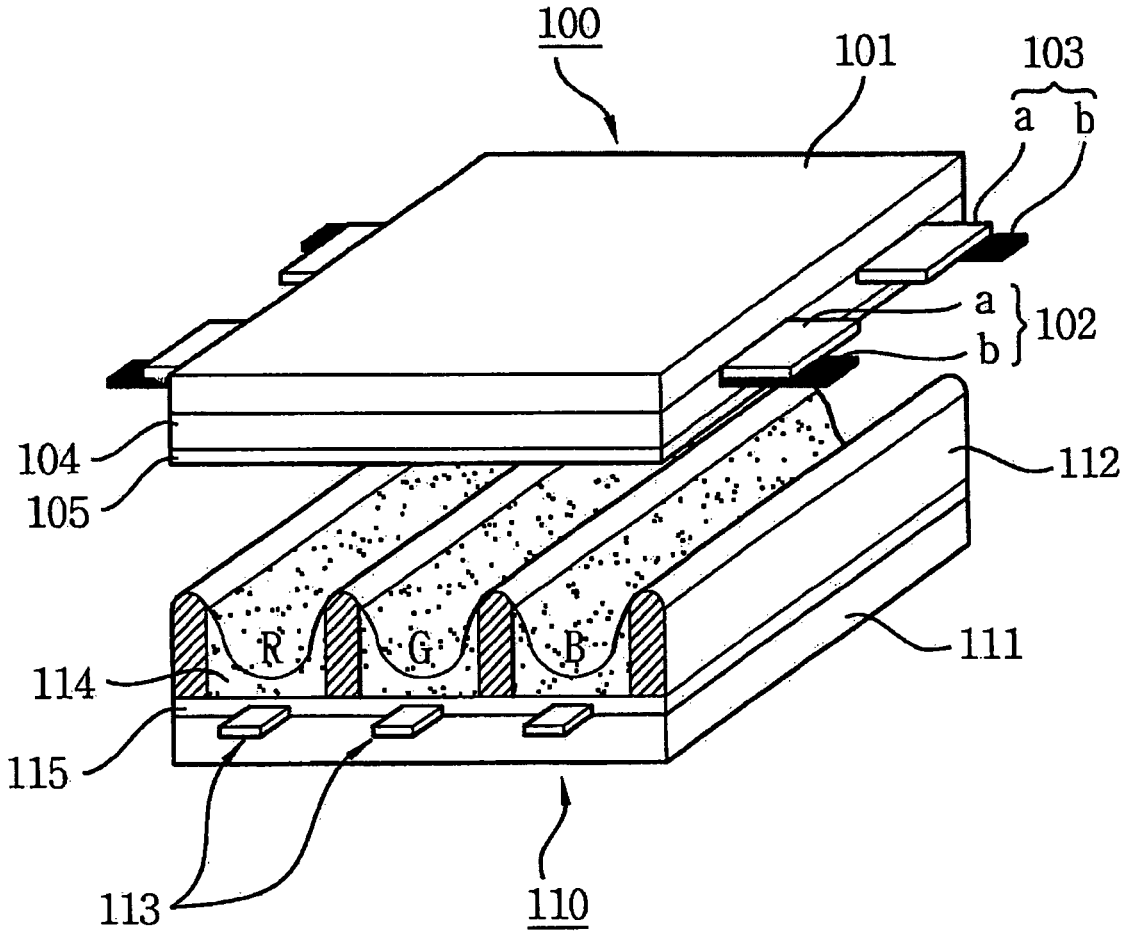
Fig. 1 Related art
FIG. 1 illustrates the structure of a common plasma display panel (PDP).
Figure 2:
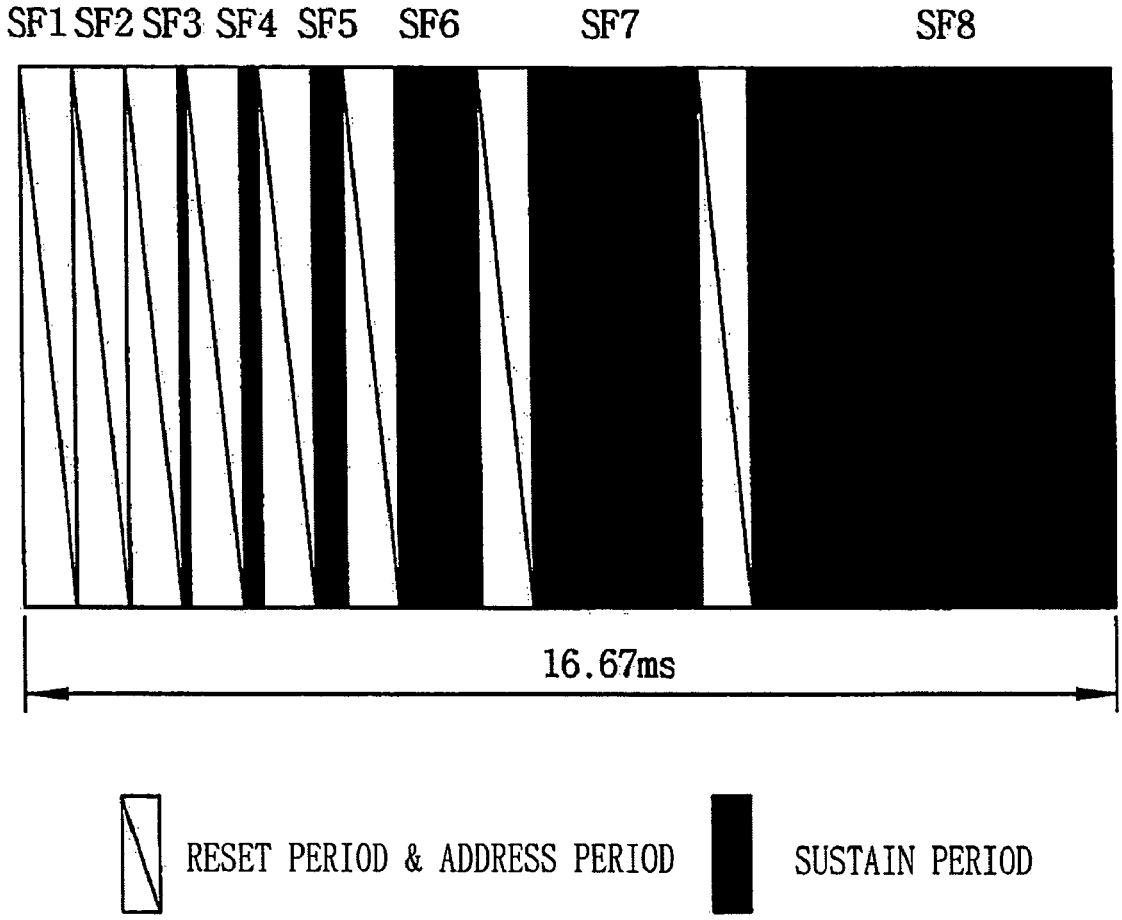
Fig. 2 Related art
FIG. 2 illustrates a conventional method of realizing gray levels of a PDP.
Figure 3:
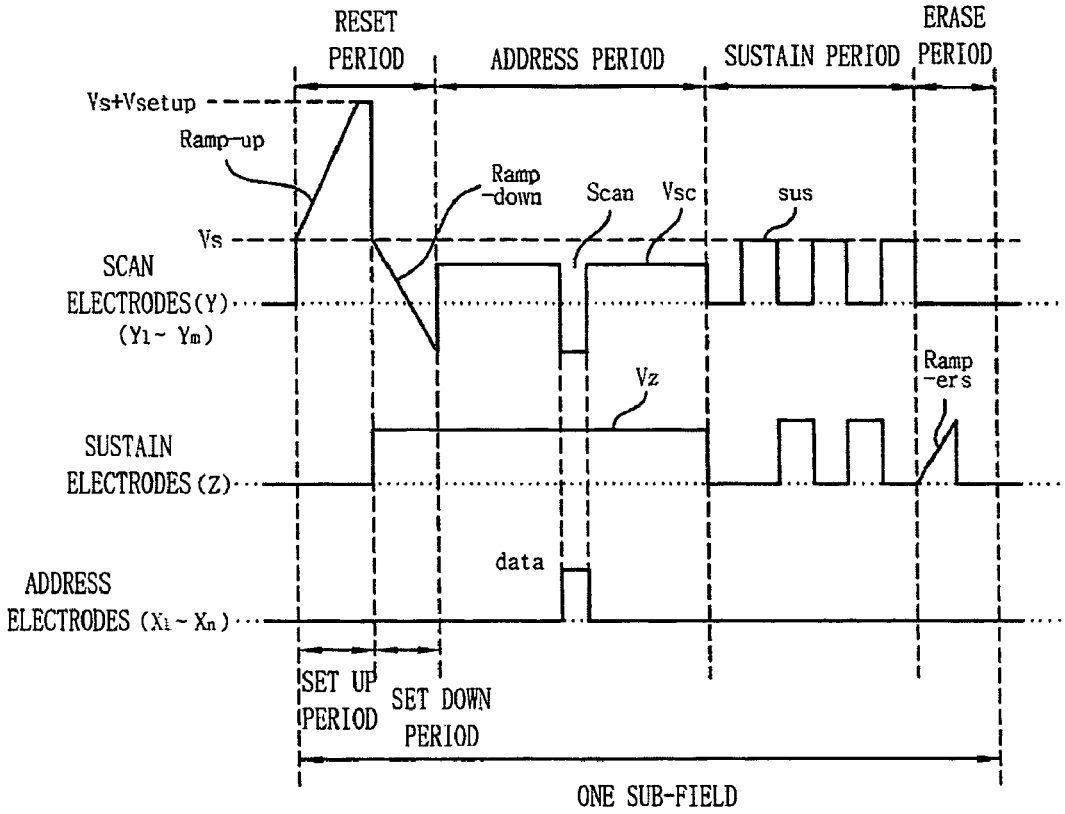
Fig. 3 Related art
FIG. 3 illustrates driving waveforms generated by the conventional apparatus for driving the PDP.
Figure 4:
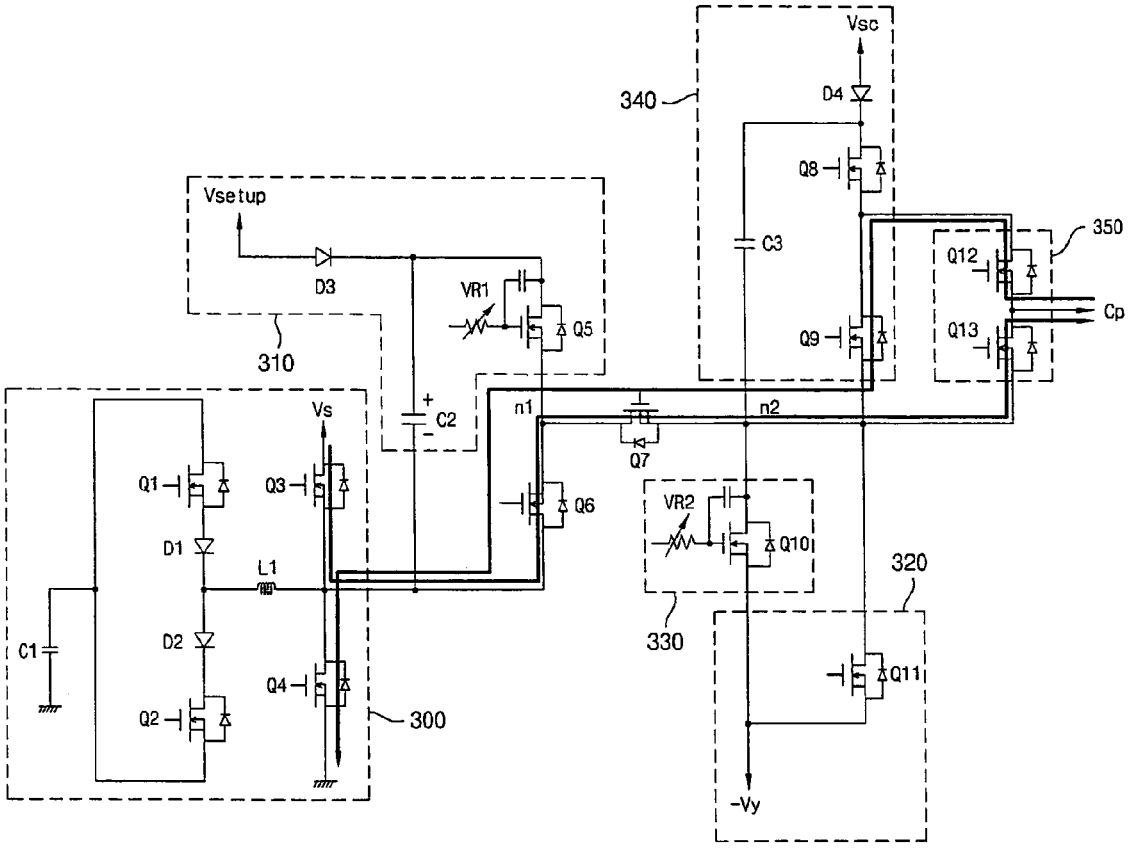
Fig. 4 Related art
FIG. 4 illustrates the conventional apparatus for driving the PDP.
Figure 5:
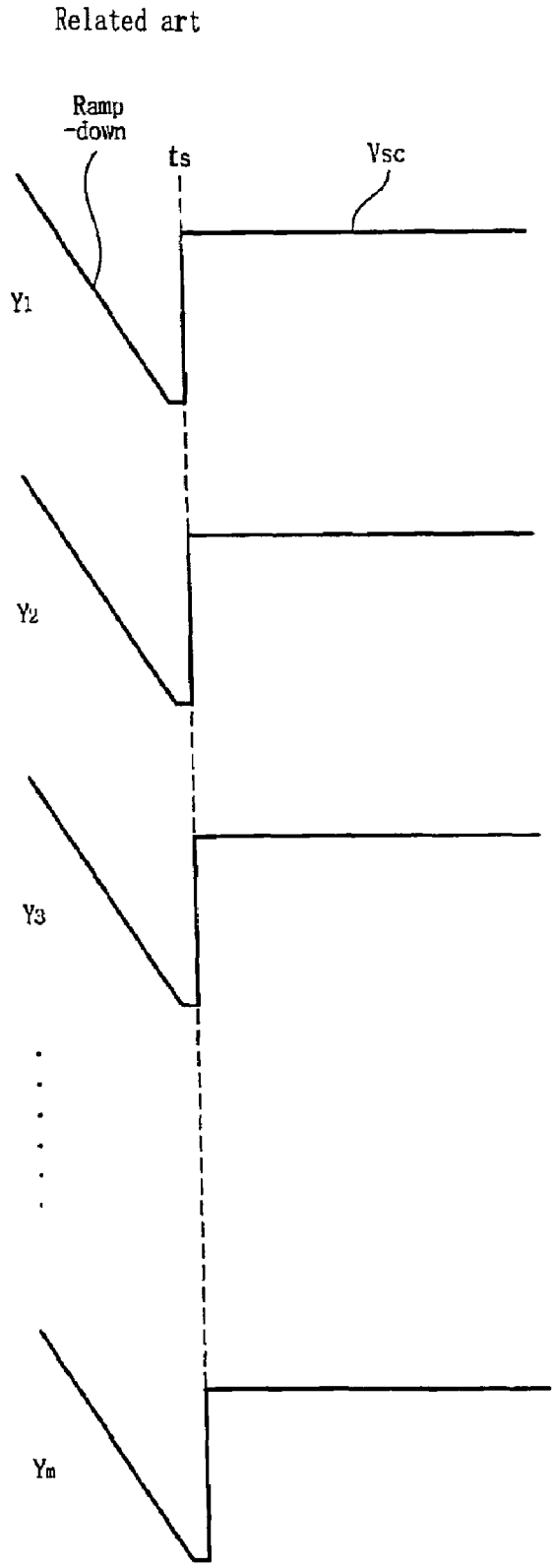
FIG. 5 illustrates a scan reference voltage supplied by the conventional apparatus for driving the PDP in an address period.
Figure 6:
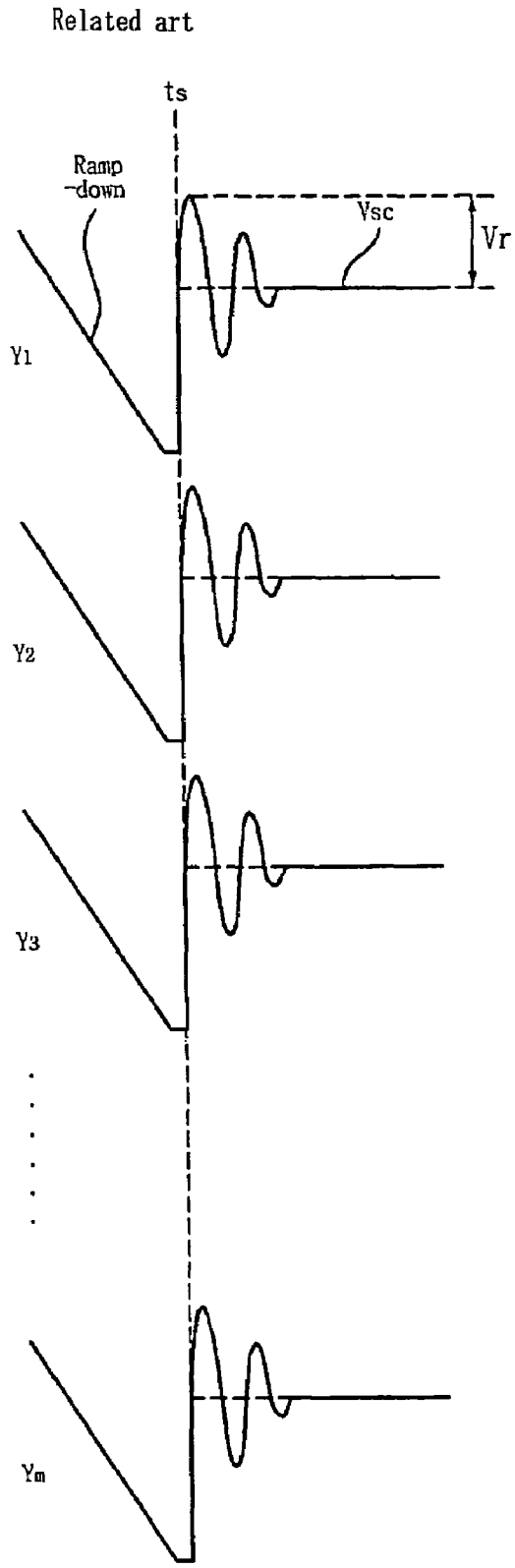
FIG. 6 illustrates noise generated by the scan reference voltage supplied by the conventional apparatus for driving the PDP in the address period to scan electrodes Y1 to Ym.
Figure 7:
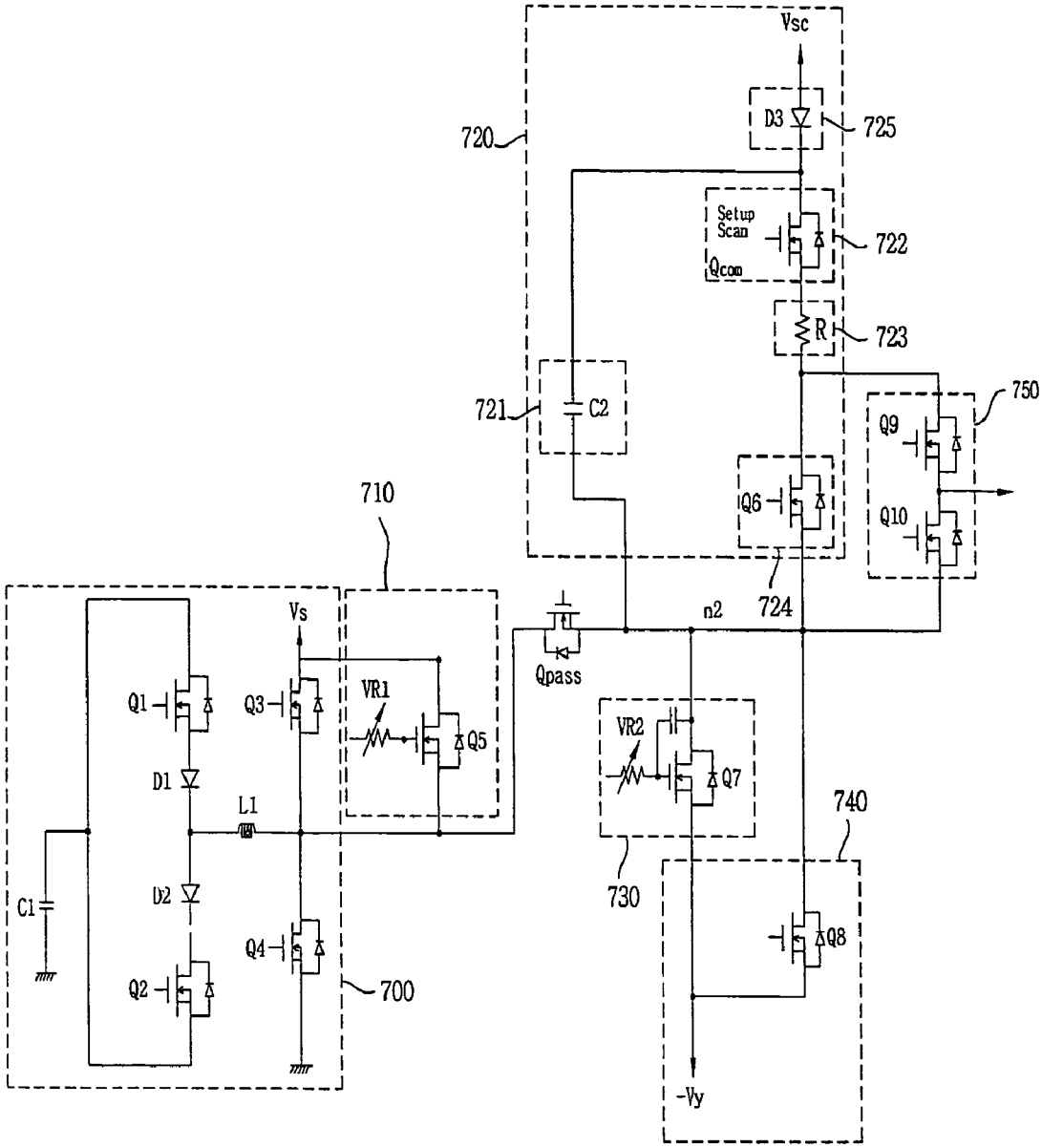
FIG. 7 illustrates an apparatus for driving a PDP according to a first embodiment of the present invention.

Referring to FIG. 7, an apparatus for driving a PDP comprises an energy recovery circuit 700, a sustain ramp supply 710, a scan reference ramp and scan reference voltage supply 720, a set down supply 730, a negative scan voltage supply 740, and a scan drive integrated circuit (IC) 750.

Here, the difference in voltage between the energy recovery circuit 700 and the set down supply 730 is large. Therefore, a pass switch Qpass for intercepting electrical connection between the energy recovery circuit 700 and the set down supply 730 when scan pulses are supplied to scan electrodes Y1 to Ym is provided between the energy recovery circuit 700 and the set down supply 730.

The scan drive IC 750 is connected in push/pull configuration and comprises ninth and tenth switches Q9 and Q10 to which voltage signals are input from the energy recovery circuit 700, the sustain ramp supply 710, the scan reference ramp and scan reference voltage supply 720, the set down supply 730, and the negative scan voltage supply 740. An output line between the ninth and tenth switches Q9 and Q10 is connected to one of the scan electrode lines Y1 to Ym (not shown).

The energy recovery circuit 700 supplies a sustain voltage Vs to a panel Cp and recovers energy from the panel Cp that would otherwise be lost. The energy recovery circuit 700 comprises, for example, an energy storage capacitor C1 for charging the energy recovered from the scan electrode lines Y1 to Ym, an inductor L1 connected between the energy storage capacitor C1 and the scan drive IC 750, a first switch Q1 connected between the inductor L1 and the external capacitor C1 in parallel, a first diode D1, a second diode D2, a second switch Q2, a third switch Q3 connected between a sustain voltage source for supplying the sustain voltage Vs and the inductor L1, and a fourth switch Q4 connected between a base voltage source for supplying a voltage of a ground level GND and the inductor L1.

The operation of the energy recovery circuit 700 will be described as follows. First, it is assumed that charge at a voltage of Vs/2 is stored in the energy storage capacitor C1. Here, when the first switch Q1 is turned on, the voltage charged in the energy storage capacitor C1 is supplied to the scan drive IC 750 via the first switch Q1, the first diode D1, the inductor L1, and the pass switch Qpass and the scan drive IC 750 supplies the voltage supplied thereto to the scan electrode lines Y1 to Ym.

At this time, since the inductor L1 constitutes a series LC resonant circuit together with the capacitance Cp' of a PDP discharge cell (not shown), the voltage of Vs is supplied to the scan electrode lines Y1 to Ym.

Then, the third switch Q3 is turned on. When the third switch Q3 is turned on, the sustain voltage Vs is supplied to the scan drive IC 750 via the internal diode of the pass switch Qpass. The scan drive IC 750 supplies the sustain voltage Vs supplied thereto to the scan electrode lines Y1 to Ym. The voltage level of the scan electrode lines Y1 to Ym is sustained as that of the sustain voltage Vs by the sustain voltage Vs so that sustain discharge is generated in the discharge cells of the panel Cp.

After the sustain discharge is generated in the discharge cells of the panel Cp, the fourth switch Q4 is turned on. When the fourth switch Q4 is turned on, reactive power is recovered to the energy storage capacitor C1 via the scan electrode lines Y1 to Ym, the scan drive IC 750, the pass switch Qpass, the inductor L1, the second diode D2, and the second switch Q2. That is, the energy from the PDP cell capacitance Cp' is recovered to the energy storage capacitor C1. Then, the fourth switch Q4 is turned on so that the voltage of the scan electrode lines Y1 to Ym is sustained to the potential GND of the ground level.

As described above, the energy recovery circuit 700 recovers the energy from the PDP cell capacitance Cp' and supplies a voltage to the scan electrode lines Y1 to Ym using the recovered energy to reduce excessive power consumption during discharge in the set up period and the sustain period.

The negative scan voltage supply 740 comprises an eighth switch Q8 connected between a first node n1 and a scan voltage source −Vy. The eighth switch Q8 is switched in response to a control signal supplied from a timing controller (not shown) in the address period to supply a negative scan voltage −Vy that falls from a scan reference voltage Vsc to the scan drive IC 750.

In the set down supply 730, a seventh switch Q7 is turned on when the pass switch Qpass is turned off in the set down period after the set up period of the reset period. The channel width of the seventh switch Q7 is controlled by a second variable resistance VR2 provided in the front end of the seventh switch Q7 so that the seventh switch Q7 falls the voltage of the first node n1 to the negative scan voltage −Vy with a predetermined slope. At this time, a set down pulse, that is, a falling ramp pulse Ramp-down is supplied to the scan electrode lines Y1 to Ym.

The scan reference ramp and scan reference voltage supply 720 supplies a first set up pulse that gradually rises to the scan reference voltage Vsc supplied by the scan reference voltage source and a second set up pulse that gradually rises from the scan reference voltage Vsc to the sum of the sustain voltage Vs and the scan reference voltage Vsc to the scan electrodes Y1 to Ym through the scan drive IC 750 in the set up period of the reset period and supplies the scan reference voltage Vsc that gradually rises with a slope in a predetermined period to the scan electrodes Y1 to Ym in the address period. The scan reference ramp and scan reference voltage supply 720 comprises a voltage control capacitor C2 721, a set up/scan common switch Qcom 722, a waveform generator R 723, and an energy path selection switch Q6 724.

A reverse current intercepting unit D3 725 for intercepting reverse current that flows from the set up/scan common switch 722 to the scan reference voltage source is provided between the scan reference voltage source for supplying the scan reference voltage Vsc of the scan reference ramp and scan reference voltage supply 720 and the drain of the set up/scan common switch 722.

Here, the scan reference voltage Vsc supplied by the scan reference voltage source is stored in the voltage control capacitor C2 721. The voltage control capacitor 721 prevents the set up reference voltage Vsc supplied to the set up/scan common switch 722 from ripple although the scan reference voltage Vsc supplied from the scan reference voltage contains ripple.

The drain of the set up/scan common switch Qcom 722 is commonly connected to the voltage control capacitor 721 and the scan reference voltage source Vsc for supplying the scan reference voltage. A set up selection signal for supplying the set up pulses to the scan electrodes Y1 to Ym is supplied to the gate terminal of the set up/scan common switch 722 in the set up period of the reset period so that the set up/scan common switch 722 is turned on in the set up period of the reset period. Also, a scan selection signal for supplying the scan reference voltage Vsc is supplied to the gate terminal of the set up/scan common switch 722 in the address period so that the set up/scan common switch 722 is turned on in the address period.

One end of the waveform generator R 723 is connected to the source terminal of the set up/scan common switch 722 and the other end of the waveform generator R 723 is connected to the scan drive IC 750. The waveform generator 723 makes the voltage of the pulse that passes through the waveform generator 723 gradually rise with a predetermined slope.

The waveform generator 723 is formed of a resistance having a predetermined value. In the present embodiment the resistance value is constant.

On the other hand, the resistance value of the waveform generator 723 may vary. For example, the resistance value of the waveform generator 723 may vary in accordance with the characteristics of the panel and the resistance of the waveform generator 723 may be a variable resistance.

The characteristics and operation of the waveform generator 723 will be described in detail as follows.

The energy path selection switch Q6 724 is turned off when the set up/scan common switch 722 is turned on so that the set up voltage or the scan reference voltage Vsc is supplied to the scan electrodes Y1 to Ym so that the set up voltage and the scan reference voltage Vsc are supplied to the ninth switch Q9 of the scan drive IC 750.

The sustain ramp generator 710 supplies the second set up pulse that gradually rises from the end of the first set up pulse supplied by the scan reference ramp and scan reference voltage supply 720 in the set up period of the reset period to the sum of the scan reference voltage Vsc and the sustain voltage Vs to the scan electrodes Y1 to Ym through the scan drive IC 750.

The sustain ramp supply 710 comprises a sustain ramp switch Q5 whose drain terminal is connected to the sustain voltage source for supplying the sustain voltage to the energy recovery circuit 700 and whose source terminal is connected to the output terminal of the energy recovery circuit 700 and a first variable resistance VR1 that is connected to the gate terminal of the sustain ramp switch Q5 and that controls the channel width of the sustain ramp switch Q5 in the set up period of the reset period to generate the second set up pulse that gradually rises from the end of the first set up pulse to the sum of the scan reference voltage Vsc and the sustain voltage Vs.

Figure 8:
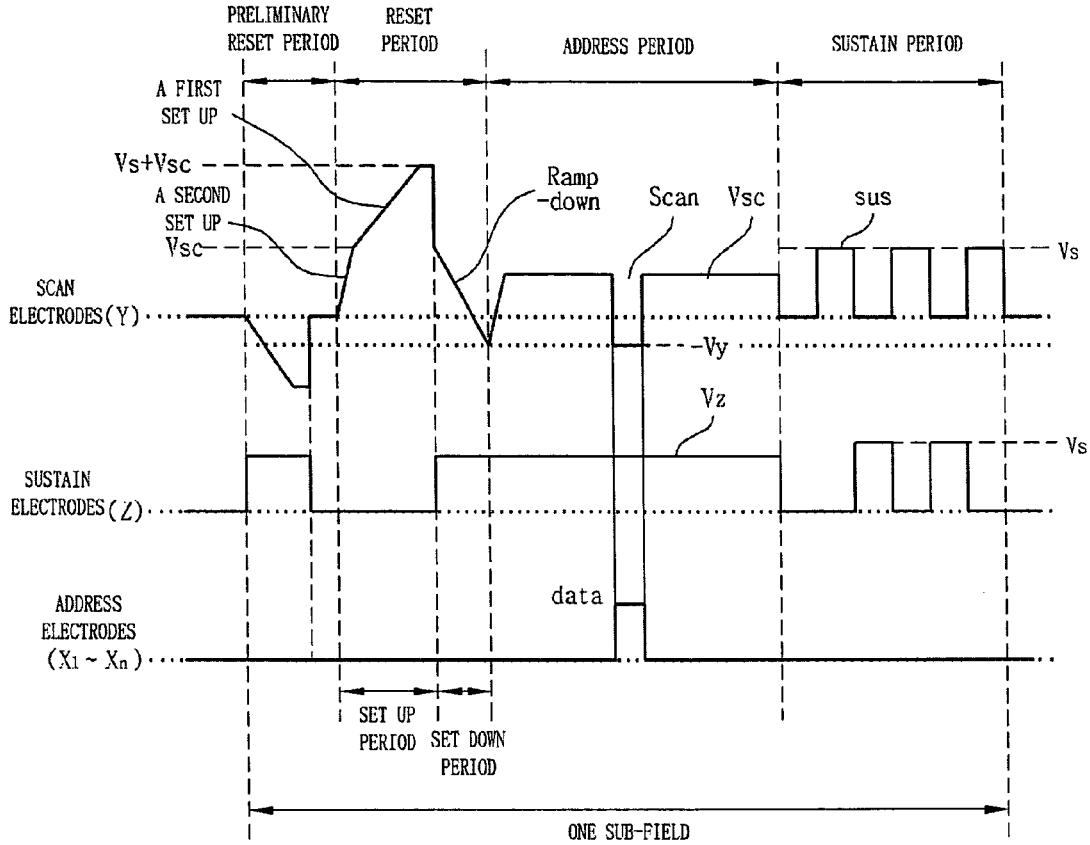
FIG. 8 illustrates driving waveforms in accordance with the apparatus for driving the PDP according to the first embodiment of the present invention.

Referring to FIG. 8, it is assumed that the voltage of Vs/2 is stored in the energy storage capacitor C1 of the energy recovery circuit 700 of FIG. 7.

The set up selection signal is supplied from the timing controller (not shown) to the gate terminal of the set up/scan common switch Qcom 722 of the scan reference ramp and scan reference voltage supply 720 in the set up period of the reset period after a preliminary reset period Pre-Rest. Then, the set up/scan common switch Qcom 722 is turned on and the scan reference voltage Vsc is supplied from the scan reference voltage source to the set up/scan common switch 722 through the reverse current intercepting unit 725.

The scan reference voltage Vsc supplied to the set up/scan common switch 722 becomes a ramp pulse that gradually rises with a predetermined slope through the waveform generator R 723. Then, the ramp pulse that is generated by the waveform generator 723 and that gradually rises to the scan reference voltage Vsc is supplied to the scan electrodes Y1 to Ym via the ninth switch Q9 of the scan drive IC 750 so that the voltage of the panel cell capacitance Cp' gradually rises to the scan reference voltage Vsc. Therefore, the first set up pulse is supplied to the scan electrodes Y1 to Ym in the set up period of the reset period as illustrated in FIG. 8.

The scan reference voltage Vsc supplied from the scan reference voltage source through the waveform generator R 723 becomes the ramp pulse that gradually rises so that the resistance of the waveform generator 723 and the cell capacitance Cp' of the panel are serially arranged to form R-C series arrangement and that an RC time constant is generated as a result.

Then, the set up selection signal supplied to the gate terminal of the set up/scan common switch 723 is intercepted and the sustain ramp switch Q5 of the sustain waveform generator 710 is turned on. Therefore, the sustain voltage Vs is supplied from the sustain voltage source that is connected to the drain terminal of the sustain ramp switch Q5 and that supplies the sustain voltage to the energy recovery circuit 700 to the sustain ramp switch 710.

Then, the channel width of the sustain ramp switch Q5 is controlled by the variable resistance VR1 connected to the gate terminal of the sustain ramp switch Q5 so that the sustain ramp switch Q5 generates the second set up pulse that gradually rises from the end of the first set up pulse supplied by the scan reference ramp and scan reference voltage supply 720 to the sum of the scan reference voltage Vsc and the sustain voltage Vs. The second set up pulse is supplied to the panel Cp through the pass switch Qpass commonly connected to the source terminal of the sustain ramp switch 710 and the output terminal of the energy recovery circuit 700 and the tenth switch Q10 of the scan drive IC 750. Therefore, the second set up pulse is supplied to the scan electrodes Y1 to Ym in the set up period of the reset period as illustrated in FIG. 8.

In the present embodiment, the slope of the second set up pulse is smaller than the slope of the first set up pulse. Therefore, the magnitude of the dark discharge generated by the set up pulses comprising the first set up pulse and the second set up pulse supplied to the scan electrodes Y1 to Ym in the reset period is reduced compared with the prior art so that contrast is improved.

As described above, the magnitude of the set up pulse is set as the sum Vs+Vsc of the sustain voltage Vs and the scan reference voltage Vsc in the set up period of the reset period so that the falling ramp pulse that gradually falls is supplied to the scan electrodes Y1 to Ym and that a predetermined positive voltage, for example, the sustain voltage Vs is supplied to sustain electrodes Z in the preliminary reset period before the reset period.

Therefore, positive wall charges before accumulated on the scan electrodes Y1 to Ym and negative wall charges become accumulated on the sustain electrodes Z before the reset period so that it is possible to create the wall charges even in the reset period although the magnitude of the set up pulse supplied in the set up period of the reset period is reduced.

The sustain ramp switch Q5 is turned off in the set down period after the set up period of the reset period. The falling ramp Ramp-Down that gradually falls from a predetermined positive voltage. In the present embodiment, the sustain voltage Vs is supplied to the scan electrodes Y1 to Ym by the set down supply 730 of FIG. 7.

The scan reference voltage Vsc that rises from the end of the falling ramp pulse supplied in the set down period of the reset period is supplied in the address period after the set down period of the reset period by the scan reference ramp and scan reference voltage supply 720. The scan selection signal is supplied from the timing controller (not shown) to the gate terminal of the set up/scan common switch 722 of the scan reference ramp and scan reference voltage supply 720 in the address period. Therefore, the set up/scan common switch Qcom 722 is turned on and the scan reference voltage Vsc is supplied from the scan reference voltage source to the set up/scan common switch 722 through the reverse current intercepting unit 725.

Then, the scan reference voltage Vsc supplied to the set up/scan common switch 722 becomes a ramp pulse that gradually rises with a predetermined slope through the waveform generator R 723. Then, the ramp pulse that is generated by the waveform generator 723 and that gradually rises to the scan reference voltage Vsc is supplied to the scan electrodes Y1 to Ym via the ninth switch Q9 of the scan drive IC 750 so that the voltage on the panel capacitance Cp' gradually rises to the scan reference voltage Vsc. Therefore, the scan reference voltage Vsc that gradually rises is supplied to the scan electrodes Y1 to Ym in the address period as illustrated in FIG. 8.

Figure 9:
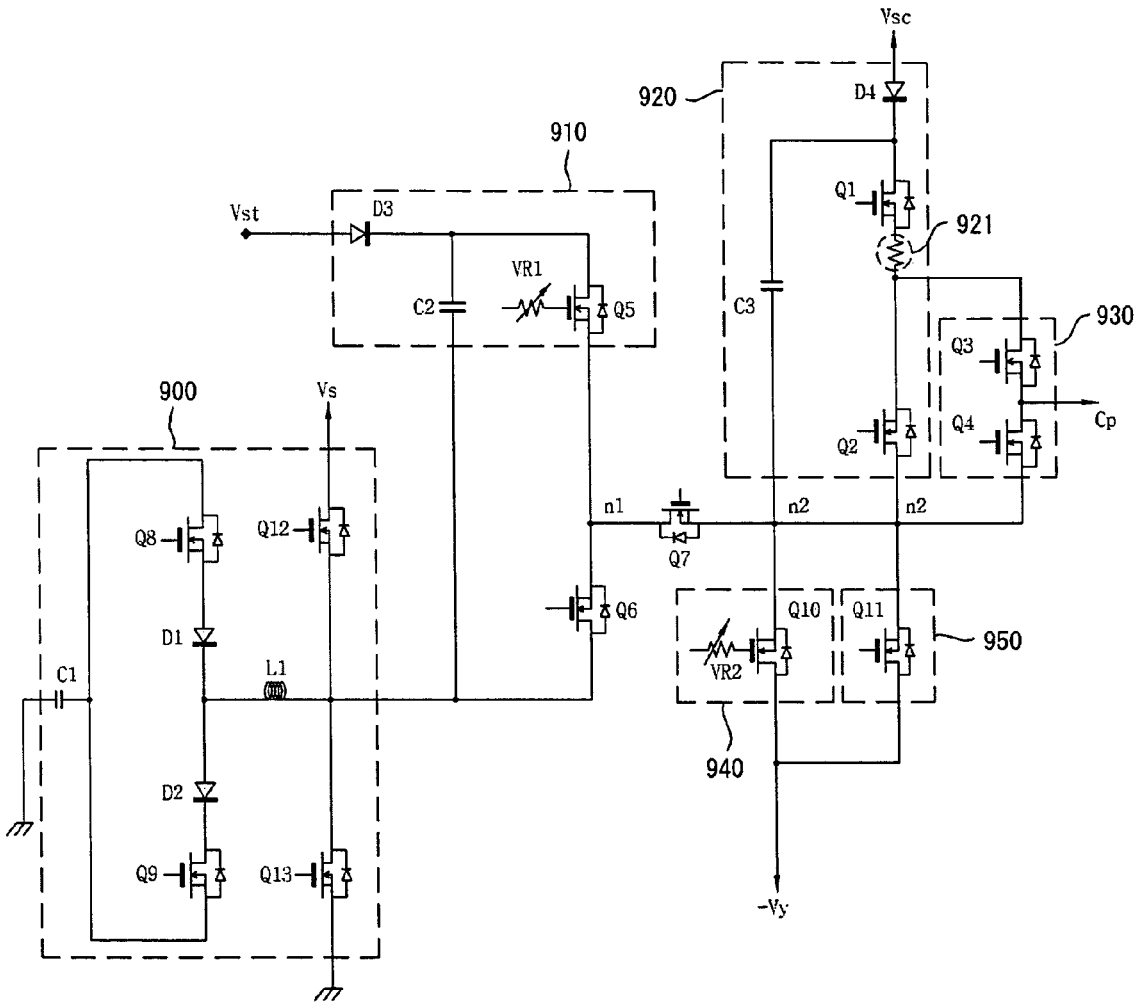
FIG. 9 illustrates an apparatus for driving a PDP according to a second embodiment of the present invention.

As shown in FIG. 9, an apparatus for driving the PDP according to the second embodiment comprises an energy recovery circuit 900, a drive IC 930, a set up supply 910, a set down supply 940, a negative scan voltage supply 950, a scan reference voltage supply 920, the seventh switch Q7 connected between the set up supply 910 and the drive IC 930, and a sixth switch Q6 connected between the set up supply 910 and the energy recovery circuit 900.

The drive IC 930 is connected in push/pull configuration and comprises third and fourth switches Q3 and Q4 to which voltage signals are input from the energy recovery circuit 900, the set up supply 910, the set down supply 940, the negative scan voltage supply 950, and the scan reference voltage supply 920. An output line between the third and fourth switches Q3 and Q4 is connected to one of the scan electrode lines Y1 to Ym of the panel Cp.

The energy recovery circuit 900 supplies a sustain voltage Vs to the panel cell capacitance Cp' and recovers energy from the panel cell capacitance Cp' that would otherwise be lost. In the present embodiment, the energy recovery circuit 900 comprises an energy storage capacitor C1 for charging the energy recovered from the scan electrode lines Y1 to Ym, an inductor L1 connected between the energy storage capacitor C1 and the scan drive IC 930, an eighth switch Q8 connected between the inductor L1 and the external capacitor C1 in parallel, the first diode D1, the second diode D2, a ninth switch Q9, a $12^{th}$ switch Q12 connected between the sustain voltage source for supplying the sustain voltage Vs and the inductor L1, and a $13^{th}$ switch Q13 connected between the base voltage source for supplying the voltage of the ground level GND and the inductor L1.

The operation of the energy recovery circuit 900 will be described as follows. First, it is assumed that a voltage of Vs/2 is stored in the energy storage capacitor C1. Here, when the eighth switch Q8 is turned on, the voltage stored in the energy storage capacitor C1 is supplied to the scan drive IC 930 via the eighth switch Q8, the first diode D1, the inductor L1, the sixth switch Q6, and the seventh switch Q7 and the scan drive IC 930 supplies the voltage supplied thereto to the scan electrode lines Y1 to Ym.

At this time, since the inductor L1 constitutes the series LC resonant circuit together with the capacitance Cp' of a PDP discharge cell, the voltage of Vs is supplied to the scan electrode lines Y1 to Ym.

Then, the $12^{th}$ switch Q12 is turned on. When the $12^{th}$ switch Q12 is turned on, the sustain voltage Vs is supplied to the scan drive IC 930 via the internal diode of the sixth switch Q6 and the seventh switch Q7. The scan drive IC 930 supplies the sustain voltage Vs supplied thereto to the scan electrode lines Y1 to Ym. The voltage level of the scan electrode lines Y1 to Ym is sustained as that of the sustain voltage Vs by the sustain voltage Vs so that sustain discharge is generated in the discharge cells of the panel Cp.

After the sustain discharge is generated in the discharge cells of the panel Cp, the $13^{th}$ switch Q13 is turned on. When the $13^{th}$ switch Q13 is turned on, reactive power is recovered to the energy storage capacitor C1 via the scan electrode lines Y1 to Ym, the scan drive IC 930, the internal diode of the seventh switch Q7, the sixth switch Q6, the inductor L1, the second diode D2, and the ninth switch Q9. That is, the energy from the PDP cell capacitance Cp' is recovered to the energy storage capacitor C1. Then, the $13^{th}$ switch Q13 is turned on so that the voltage of the scan electrode lines Y1 to Ym is sustained to the potential GND of the ground level.

As described above, the energy recovery circuit 900 recovers the energy from the PDP cell capacitance Cp' and supplies a voltage to the scan electrode lines Y1 to Ym using the recovered energy to reduce excessive power consumption during discharge in the set up period and the sustain period.

The negative scan voltage supply 950 comprises an $11^{th}$ switch Q11 connected between the first node n1 and the scan voltage source −Vy. The $11^{th}$ switch Q11 is switched in response to the control signal supplied from the timing controller (not shown) in the address period to supply the negative scan voltage −Vy that falls from the scan reference voltage Vsc to the scan drive IC 930.

The set up supply 910 comprises a third diode D3 connected between a set up voltage source Vst and the first node n1, the fifth switch Q5, and a second capacitor C2 provided between the set up voltage source Vst and the energy recovery circuit 900. The third diode D3 intercepts reverse current that flows from the second capacitor C2 to the set up voltage source Vst. The second capacitor C2 stores the set up voltage Vst so that the voltage supplied to the fifth switch Q5 maintains the set up voltage Vst uniform in the set up period of the reset period.

In the set down supply 940, the sixth switch Q6 is turned off and the tenth switch Q10 is turned on in the set down period after the set up period of the reset period. The channel width of the tenth switch Q10 is controlled by the second variable resistance VR2 provided in the front end of the tenth switch Q10 so that the tenth switch Q10 falls the voltage of the first node n1 to the negative scan voltage −Vy with a predetermined slope. At this time, the set down pulse, that is, the falling ramp pulse Ramp-down is supplied to the scan electrode lines Y1 to Ym.

The scan reference voltage supply 920 comprises a voltage sustaining unit C3 comprising a capacitor connected between the scan voltage source Vsc and the common node n2 and the first and second switches Q1 and Q2 connected between the scan voltage source Vsc and the common node n2. The first and second switches Q1 and Q2 are switched by the control signal supplied from the timing controller in the address period to supply the voltage of the scan voltage source Vsc to the drive IC 930. The voltage sustaining unit C3 makes the voltage supplied to the first switch Q1 sustain the scan reference voltage Vsc supplied from the scan reference voltage source uniform.

A reverse current intercepting unit D4 for intercepting reverse current that flows from the first switch Q1 to the scan reference voltage source Vsc is preferably further comprised between the scan reference voltage source for supplying the scan reference voltage Vsc to the scan reference voltage supply 920 and the first switch Q1.

Here, the scan reference voltage Vsc supplied by the scan reference voltage source is stored in the voltage sustaining unit C3. The voltage sustaining unit C3 smooths the waveform of the scan reference voltage Vsc supplied from the scan reference voltage source, maintaining it uniform.

One end of the waveform generator 921 is connected in series with the first switch Q1 and the other end of the waveform generator 921 is connected to the scan drive IC 930. The waveform generator 921 makes the scan reference voltage Vsc gradually rise with a slope in a predetermined period in the address period after the set down period when the first switch Q1 is turned on.

In this embodiment, the waveform generator 921 is formed of a fixed resistance having a predetermined value. However, it may be formed of a variable resistance.

The resistance value of the waveform generator 921 may vary in accordance with the characteristics of the PDP. For example, the magnitude of the waveform generator 921 may vary in accordance with the composition ratios of the discharge gases in the discharge cell of the PDP or variables such as the characteristics of a phosphor and the distance between electrodes in the discharge cell of the PDP.

The characteristics and operation of the waveform generator 921 will now be described in detail with reference to the driving waveforms.

Figure 10:
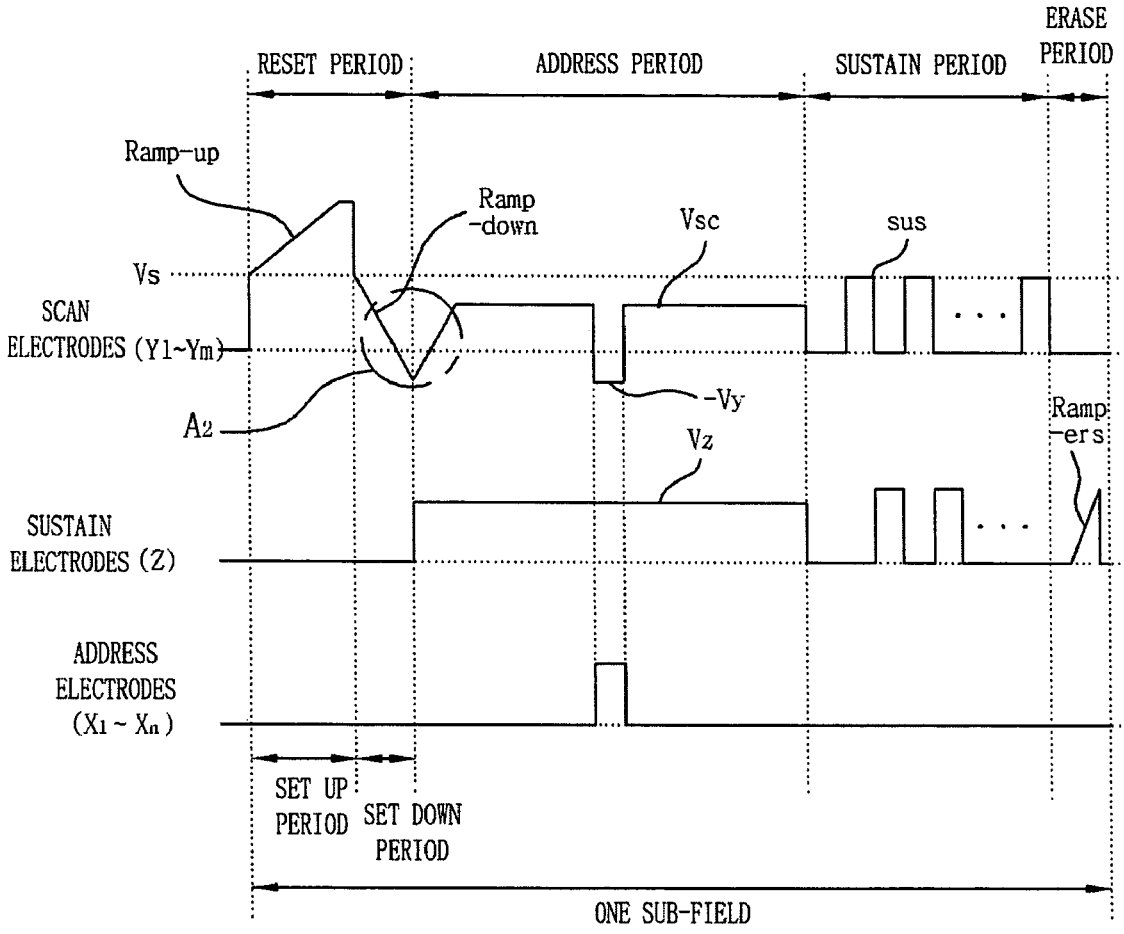
FIG. 10 illustrates driving waveforms in accordance with apparatus for driving the PDP according to the second embodiment of the present invention.

As illustrated in FIG. 10, the PDP is driven such that each sub-field is divided into a reset period for initializing all of the cells, an address period for selecting a cell to be discharged, a sustain period for sustaining the discharge of the selected cell, and an erase period for erasing wall charges in the discharged cell.

In the set up period of the reset period, a rising ramp waveform Ramp-up is simultaneously applied to all of the scan electrodes Y1 to Ym. Dark discharge is generated in the discharge cells of the entire screen due to the rising ramp waveform. Positive wall charges become accumulated on the address electrodes X1 to Xn and the sustain electrodes Z and negative wall charges become accumulated on the scan electrodes Y1 to Ym due to the set up discharge.

In the set down period of the reset period, after the rising ramp waveform is supplied, a falling ramp waveform Ramp-down that starts to fall from a positive voltage lower than the peak voltage of the rising ramp waveform and to thus fall to a specific voltage level no more than a ground GND level generates weak erase discharge in the cells to erase the wall charges excessively formed in the scan electrodes Y1 to Ym. The wall charges to the amount that can stably generate the address discharge uniformly reside in the cells due to the set down discharge.

In the address period, a negative scan pulse is sequentially applied to the scan electrodes Y1 to Ym and, at the same time, a positive data pulse is applied to the address electrodes X1 to Xn in synchronization with the scan pulse. When the difference in voltage between the scan pulse and the data pulse is added to the wall voltage generated in the reset period, an address discharge is generated in the discharge cell to which the data pulse is applied.

Wall charges to the amount that can generate discharge when the sustain voltage Vs is applied are formed in the cells selected by the address discharge. A positive bias voltage Vz is supplied to the sustain electrodes Z in the set down period and the address period so that difference in voltage between the scan electrodes Y1 to Ym and the sustain electrodes Z is reduced to prevent erroneous discharge from being generated between the scan electrodes Y1 to Ym and the sustain electrodes Z.

In the sustain period, sustain pulses sus are alternately applied to the scan electrodes Y1 to Ym and the sustain electrodes Z. In the cells selected by the address discharge, the wall voltage in the cells is added to the sustain pulse so that the sustain discharge, that is, display discharge is generated between the scan electrodes Y1 to Ym and the sustain electrodes Z whenever each sustain pulse is applied.

After the sustain discharge is completed, a voltage of an erase ramp waveform Ramp-ers having small pulse width and voltage level is supplied to the sustain electrodes in the erase period to erase the wall charges that reside in the cells of the entire screen.

Figure 11:
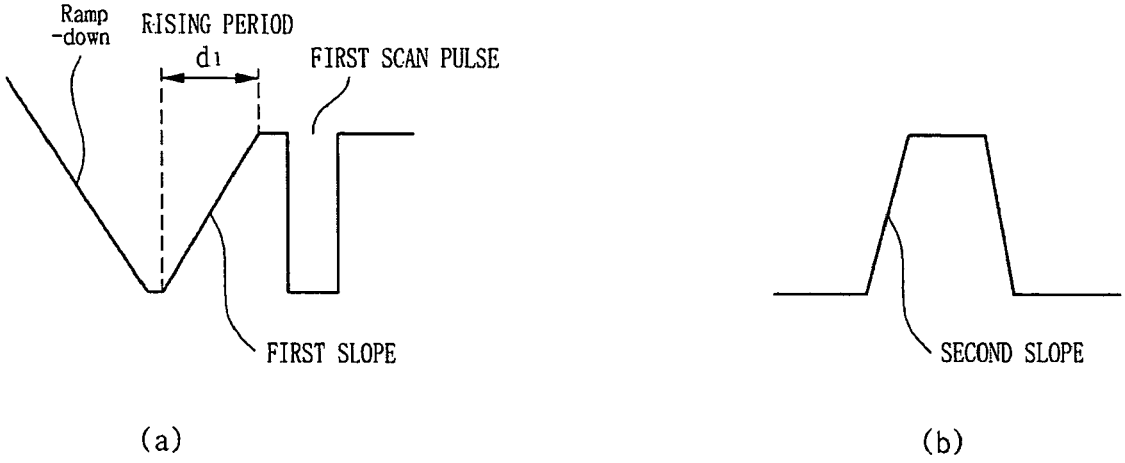
FIG. 11 illustrates the operation of the waveform generator of the apparatus for driving the PDP according to the embodiments of the present invention.

Here, in the apparatus for driving the PDP, the scan reference voltage supply supplies the scan reference voltage that rises with a slope in a predetermined period in the address period (area A2) after the reset period, which will be described in detail with reference to FIG. 11.

As illustrated in FIG. 11A, after the falling ramp pulse Ramp-down supplied in the set down period of the reset period is completed, the scan reference voltage is supplied with the start of the address period. At this time, the waveform generator makes the scan reference voltage rise with a slope (a first slope) in a predetermined period.

The waveform that gradually rises is applied so that change in voltage gradually occurs and that it is possible to reduce noise as a result. Therefore, driving is stabilized so that it is possible to improve driving efficiency.

Also, noise is reduced so that it is possible to prevent circuit devices from being electrically damaged and to thus reduce manufacturing cost of the devices.

Here, the predetermined period is within the period from the point of time where the scan reference voltage supplied in the address period starts to rise to the point of time where the first scan pulse is supplied to the scan electrodes Y1 to Ym, which is the maximum time for which the ramp pulse can be sustained and by which it is possible to effectively reduce noise.

Also, as illustrated in FIG. 11A, the rising time d1 of the scan reference voltage controlled to be within the period from the point of time where the scan reference voltage starts to rises to the point of time where the first scan pulse is supplied, and in the present exemplary embodiment is preferably between 0 μs and 20 μs.

In the present embodiment, the rising time d1 is more preferably between 6 μm and 10 μm in order to prevent a driving margin from deteriorating due to increase in driving time.

Also, in the present embodiment, the voltage of the end of the set down pulse is preferably equal to the voltage −Vy of the scan pulse that falls from the scan reference voltage Vsc to simplify driving.

When FIGS. 11A and 11B are compared with each other, the slope (the first slope) with which the scan reference voltage rises in the predetermined period after the set down period is preferably smaller than a slope (a second slope) of the sustain pulse applied in the sustain period.

That is, the rising slope (the first slope) of the rising waveform of the scan reference voltage is made smaller than the rising slope (the second slope) of the sustain pulse in ER-Up Time where the voltage of the sustain pulse rises so that change in voltage per time is reduced and that noise is reduced as a result.

The effect of the scan reference voltage according to the present embodiment will be described in detail with reference to FIG. 12.

Figure 12:
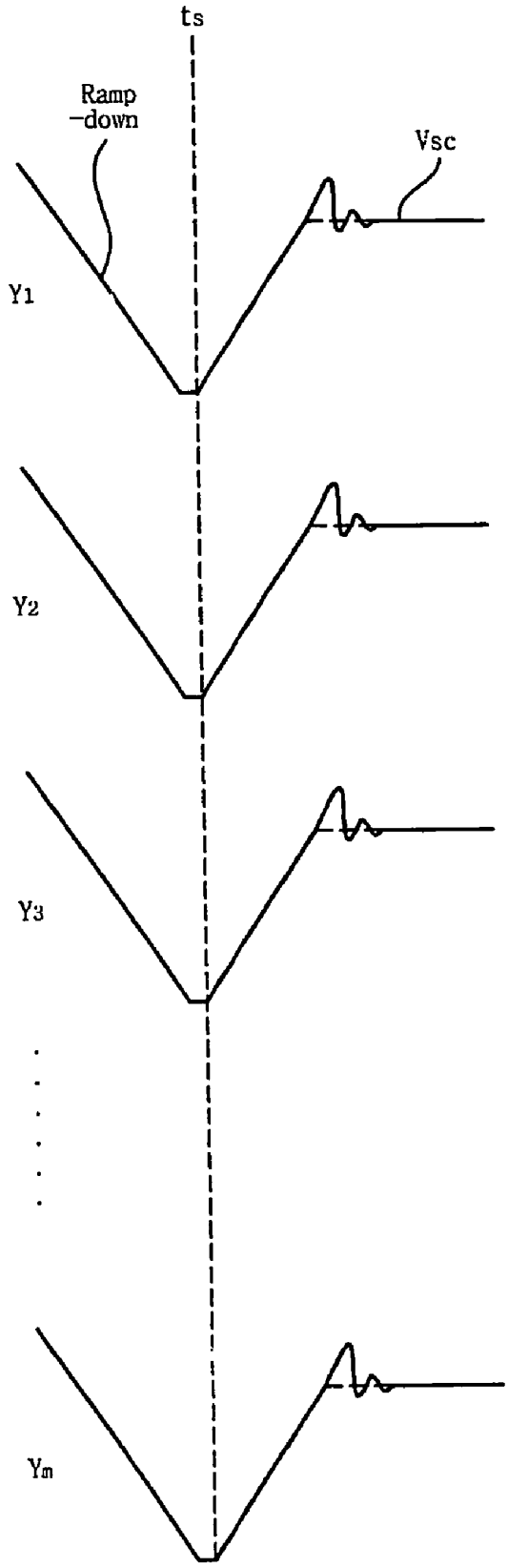
FIG. 12 illustrates noise generated by the scan reference voltage supplied by the apparatus for driving the PDP according to the present invention in the address period to the scan electrodes Y1 to Ym.

As illustrated in FIG. 12, when the apparatus for driving the PDP supplies the scan reference voltage Vsc that rises with the predetermined slope to the scan electrodes Y1 to Ym in the address period, the generation of noise is reduced in the driving waveforms applied to the scan electrodes Y1 to Ym compared with the prior art.

The noise is reduced because the instantaneous voltage change ratio of the scan reference voltage Vsc is reduced so that the influence of coupling through the capacitance of the panel is reduced.

As described above, the scan reference voltage Vsc applied to the scan electrodes Y1 to Ym in the address period gradually rises with the predetermined slope so that, when the generation of noise is reduced, it is possible to prevent driving of the PDP from being unstable.

Although not described above, the magnitude of the resistance of the waveform generator corresponding to the plurality of scan electrodes Y1 to Ym on the PDP may have at least one different values, which will be described as follows.

Before describing the case in which the resistance of the waveform generator has two or more different resistance values, an example of a method of dividing the scan electrodes Y1 to Ym of the PDP into a plurality of scan electrode groups will be described with reference to FIG. 13.

Figure 13:
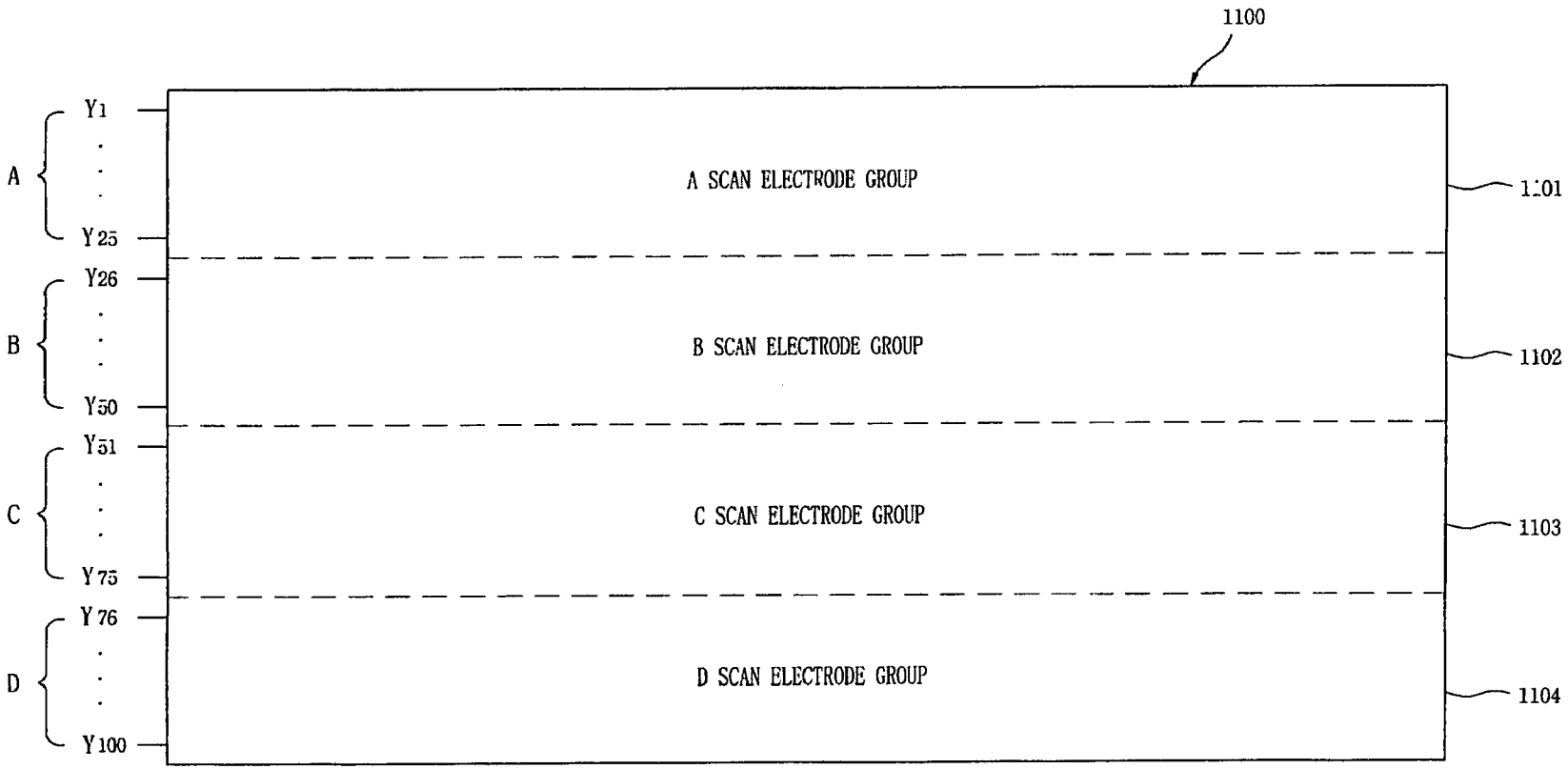
FIG. 13 illustrates that the scan electrodes Y1 to Ym formed on the PDP are divided into four scan electrode groups in order to describe a method of driving the PDP according to the present invention.

As illustrated in FIG. 13, when it is assumed that the total number of scan electrodes formed on a PDP 1100 is 100, the scan electrodes Y1 to Y100 are divided into an A scan electrode group Y1 to Y25 1101, a B scan electrode group Y26 to Y50 1102, a C scan electrode group Y51 to Y75 1103, and a D scan electrode group Y76 to Y100 1104. Here, in the case of FIG. 13, each of the scan electrode groups comprises 25 scan electrodes.

The number of scan electrode groups may be $2 \leqq N \leqq (n-1)$.

In FIG. 13, the number of scan electrodes comprised in each of the scan electrode groups 1101, 1102, 1103, and 1104 is the same. However, the number of scan electrodes comprised in each of the scan electrode groups 1101, 1102, 1103, and 1104 may vary. Also, the number of scan electrode groups may be controlled. An example in which the number of scan electrodes comprised in each of the scan electrode groups varies or the number of scan electrode groups is controlled will be described with reference to FIG. 14.

Figure 14:
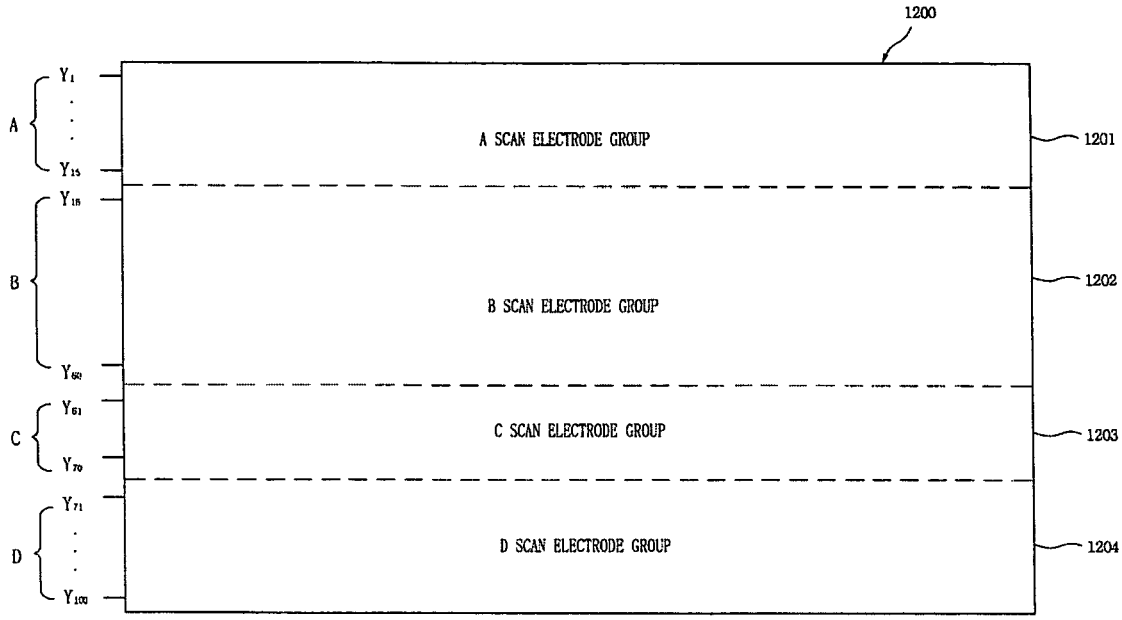
FIG. 14 illustrates an example in which the plurality of scan electrodes formed on the PDP are divided into scan electrode groups comprising at least one different numbers of scan electrodes, respectively.

Referring to FIG. 14, when it is assumed that the total number of scan electrodes formed on a PDP 1200 is 100, the scan electrodes Y1 to Y100 are divided into an A scan electrode group Y1 to Y15 1201 comprising 15 scan electrodes, a B scan electrode group Y16 to Y60 1202 comprising 45 scan electrodes, a C scan electrode group Y61 to Y70 1203 comprising 10 scan electrodes, and a D scan electrode group Y71 to Y100 1204 comprising 30 scan electrodes.

The apparatus for driving the PDP will be described based on the concept of the scan electrode groups described with reference to FIGS. 13 and 14.

Figure 15:
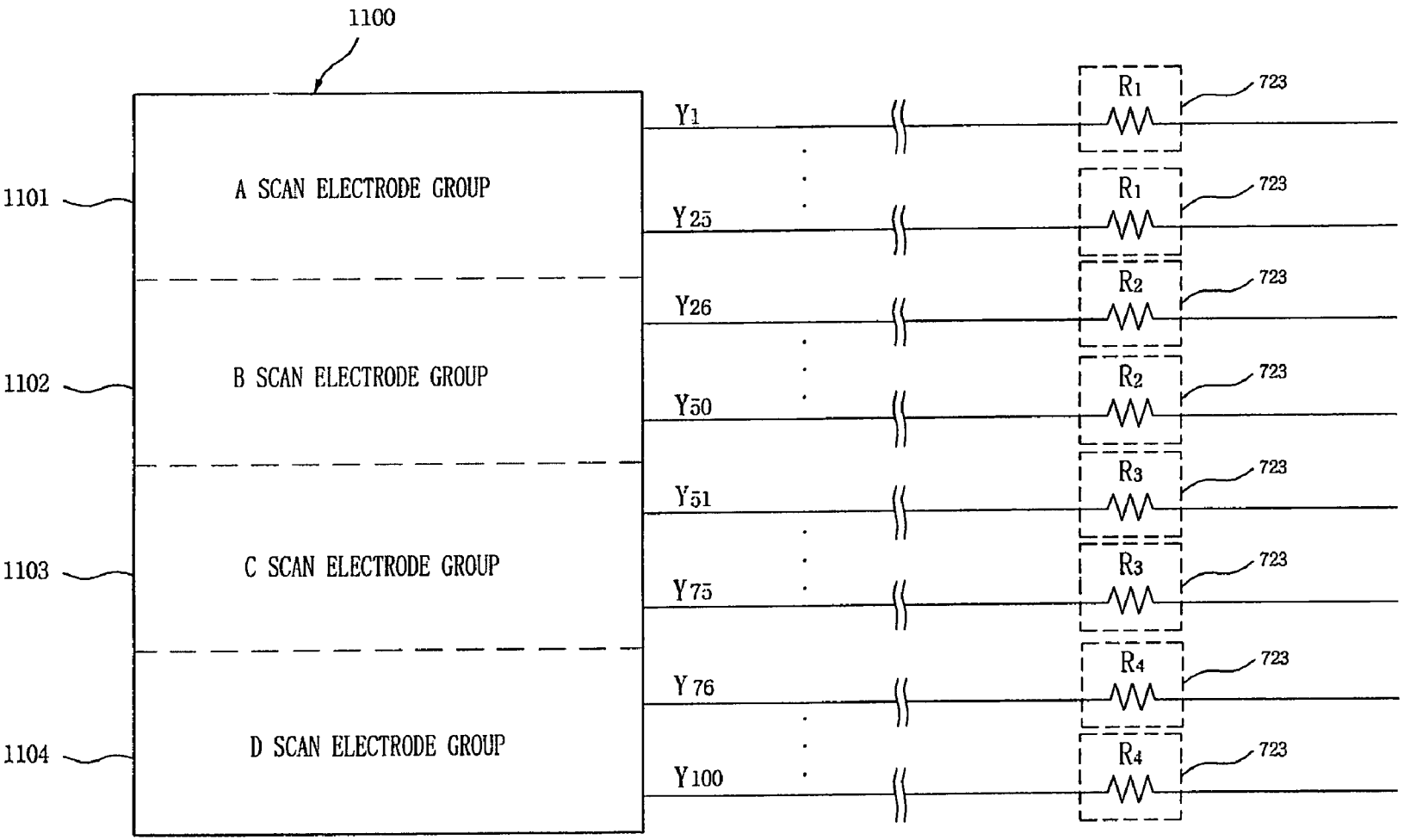
FIG. 15 illustrates the magnitudes of the resistances of the waveform generator corresponding to the scan electrode groups in the apparatus for driving the PDP according to the present invention.

Referring to FIG. 15, the resistance R of the waveform generator 723 or 921 of FIG. 7 or 9 that generates a slope so that the scan reference voltage Vsc supplied to the plurality of scan electrodes in the address period rises with the slope in the predetermined period of the address period after the reset period, is connected to the plurality of scan electrodes. Here, the magnitude of the resistance R of the waveform generator corresponding to at least one scan electrode group among the plurality of scan electrode groups each comprising at least one scan electrodes is different from the magnitudes of the resistances R of the waveform generator corresponding to the other scan electrode groups.

For example, in the case where the 100 scan electrodes are comprises in the PDP 1100 as illustrated in FIG. 15 and the 100 scan electrodes are divided into the A, B, C, and D scan electrode groups 1101, 1102, 1103, and 1104 each comprising 25 scan electrodes, the resistance of the waveform generator 723 or 921 corresponding to the scan electrodes of the A scan electrode group Y1 to Y25 1101 is R1.

Also, the resistance of the waveform generator 723 or 921 corresponding to the scan electrodes of the B scan electrode group Y26 to Y50 1102 is R2 different from R1.

Also, the resistance of the waveform generator 723 or 921 corresponding to the scan electrodes of the C scan electrode group Y51 to Y75 1103 is R3 different from R1 and R2.

Also, the resistance of the waveform generator 723 or 921 corresponding to the scan electrodes of the D scan electrode group Y76 to Y100 1104 is R4 different from R1, R2, and R3.

In the present embodiment, in one scan electrode group comprising the plurality of scan electrodes among the plurality of scan electrode groups, the magnitude of the resistance of the waveform generator 723 or 921 corresponding to each scan electrode is the same. For example, when it is assumed that one scan electrode group among the plurality of scan electrode groups comprises 10 scan electrodes, the value of the resistance of the waveform generator 723 or 921 corresponding to each of the 10 scan electrodes is the same.

The magnitudes of the resistances R1, R2, R3, and R4 are controlled so that the period from the point of time where the scan reference voltage Vsc starts to rise to the point of time where the first scan pulse is supplied is between 0 μs and 20 μs. The magnitudes of the resistances of the waveform generator 723 or 921 will be described in detail with reference to FIGS. 16A and 16B.

Here, the values of the resistances R1, R2, R3, and R4 are different from each other. However, the value of at least one resistance selected from the resistances R1, R2, R3, and R4 may be different from the value of the other resistances. For example, among the resistances R1, R2, R3, and R4, the resistances R1, R2, and R3 may have the same value and the resistance R4 may have a value different from the value of the resistances R1, R2, and R3.

As described above, the value of at least one resistance of the waveform generator 723 or 921 corresponding to the plurality of scan electrode groups is made different from the value of the other resistances so that the scan reference voltage Vsc supplied to the scan electrodes in the address period gradually rises with the predetermined slope, which will be described with reference to FIGS. 16A and 16B.

Figure 16A:
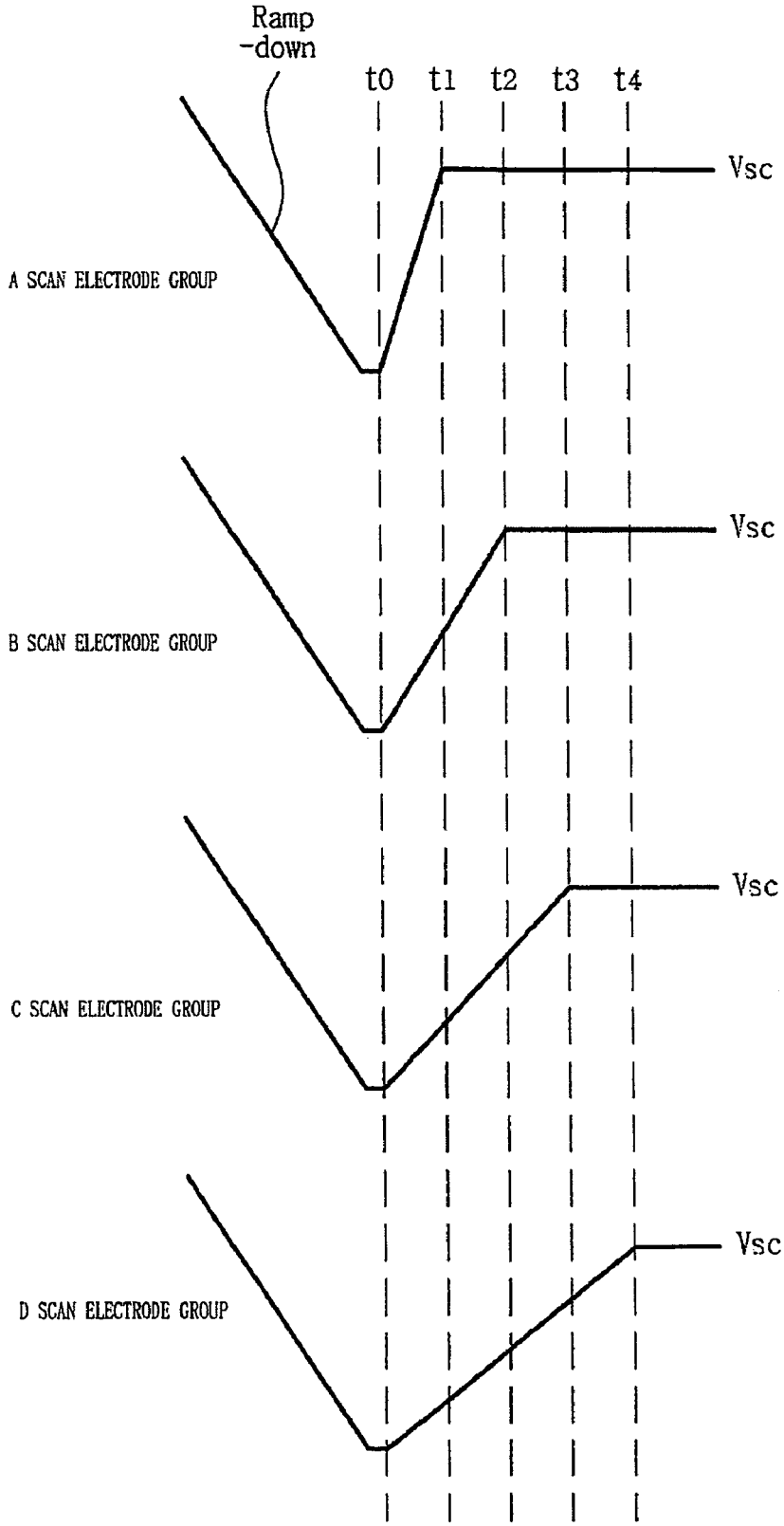
FIGS. 16A and 16B illustrate an example of changes in rising time of the scan reference voltage Vsc in accordance with the resistance values of the waveform generator.

First, referring to FIG. 16A, the rising time of the scan reference voltage Vsc supplied to the scan electrodes in the address period is controlled in accordance with the resistance values of the waveform generator of the apparatus for driving the PDP corresponding to the plurality of scan electrode groups on the PDP.

For example, as illustrated in FIG. 16A, the scan reference voltage that starts to rise at the point of time of t0 and that reaches the scan reference voltage value Vsc at the point of time t1 is supplied to all of the scan electrodes comprised in the A scan electrode group illustrated in FIG. 15 in the address period, which is achieved by the resistance R1 of the waveform generator of FIG. 15.

Also, the scan reference voltage that starts to rise at the point of time of t0 and that reaches the scan reference voltage value Vsc at the point of time t2 is supplied to all of the scan electrodes comprised in the B scan electrode group in the address period, which is achieved by the resistance R2 of the waveform generator of FIG. 15. Here, that the rising time of the scan reference voltage supplied to all of the scan electrodes comprised in the B scan electrode group is larger than the rising time of the scan reference voltage supplied to all of the scan electrodes comprised in the A scan electrode group means that the value of the resistance R2 is larger than the value of the resistance R1.

Also, the scan reference voltage that starts to rise at the point of t0 and that reaches the scan reference voltage value Vsc at the point of t3 is supplied to all of the scan electrodes comprised in the C scan electrode group in the address period, which is achieved by the resistance R3 of the waveform generator of FIG. 15. This means that the value of the resistance R3 is larger than the values of the resistances R1 and R2.

Also, the scan reference voltage that starts to rise at the point of t0 and that reaches the scan reference voltage value Vsc at the point of t4 is supplied to all of the scan electrodes comprised in the D scan electrode group in the address period, which is achieved by the resistance R4 of the waveform generator of FIG. 15. This means that the value of the resistance R4 is larger than the values of the resistances R1, R2, and R3.

That is, the rising time of the scan reference voltage Vsc supplied to the scan electrodes in the address period varies in accordance with the value of the resistance of the waveform generator corresponding to each of the scan electrode groups.

Here, the rise time of the scan reference voltage is time from the point of time where the voltage applied to the scan electrodes Y after the set down period of the reset period starts to rise to the point of time where the voltage reaches the scan reference voltage value Vsc and in the present embodiment is preferably between 0 μs and 20 μs.

That is, the magnitudes of the resistances R1, R2, R3, and R4 of the waveform generator are controlled so that the rise time of the scan reference voltage is between 0 μs and 20 μs.

Also, in FIG. 16A, the resistance values of the waveform generator are controlled so that difference between the rise times of the two scan reference voltages having different rise times is the same. That is, when the difference between the rise time of the scan reference voltage applied to the A scan electrode group and the rise time of the scan reference voltage applied to the B scan electrode group is 5 μs, the difference between the rise time of the scan reference voltage applied to the B scan electrode group and the rise time of the scan reference voltage applied to the C scan electrode group is also set as 5 μs. In addition, the difference between the rise time of the scan reference voltage applied to the C scan electrode group and the rise time of the scan reference voltage applied to the D scan electrode group is also set as 5 μs.

Unlike the above, in a modification, the resistance values of the waveform generator may be controlled so that the respective differences between the rise times of two scan reference voltages having different rise times varies. Such driving waveforms will be described with reference to FIG. 16B.

Figure 16B:
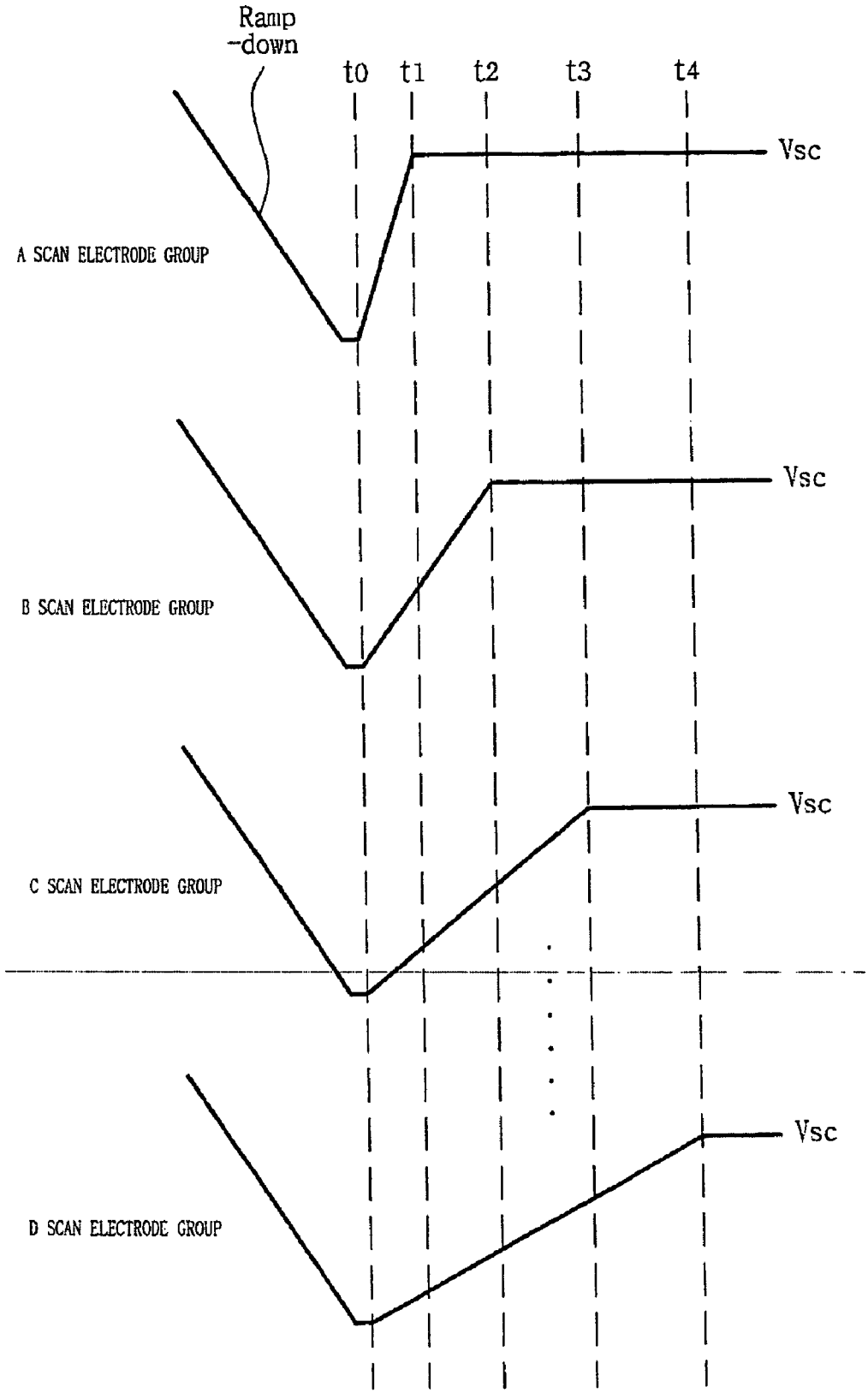

Referring to FIG. 16B, the respective differences between the rise times of two scan reference voltages having different rise times varies. That is, the resistance values of the waveform generator are controlled so that, when the difference between the rise time of the scan reference voltage applied to the A scan electrode group and the rise time of the scan reference voltage applied to the B scan electrode group, that is, the difference between t2 and t1, is 5 μs, the difference between the rise time of the scan reference voltage applied to the B scan electrode group and the rise time of the scan reference voltage applied to the C scan electrode group, that is, difference between t3 and t2 is set as 7 μs.

Also, the resistance values of the waveform generator are controlled so that difference between the rise time of the scan reference voltage applied to the C scan electrode group and the rise time of the scan reference voltage applied to the D scan electrode group, that is, difference between t4 and t3, is set as 10 μs.

Therefore, the magnitude of the noise generated by the scan reference voltage applied to the scan electrodes in the address period is significantly reduced.

On the other hand, the scan electrodes are divided into a plurality of scan electrode groups so that the rise times of the scan reference voltages applied to all of the scan electrodes Y1 to Ym are different from each other and that the rise time of the scan reference voltage applied to at least one scan electrode group in the address period is different from the rise times of the scan reference voltage applied to the remaining scan electrode groups.

At this time, the coupling through the capacitance of the panel is reduced at the point of time where the scan reference voltage is applied so that the rising noise generated in the waveforms applied to the scan electrodes is reduced at the point of time where the scan reference voltage rapidly rises. Therefore, it is possible to prevent the PDP driving device, for example, the scan driver IC of the scan driver from being electrically damaged.

The resistance values of the waveform generator are controlled so that the scan electrodes Y1 to Ym are divided into a plurality of scan electrode groups and that the rise time of the scan reference voltage applied to each scan electrode in the address period varies. However, unlike the above, the rise time of the scan reference pulse applied to each scan electrode in the address period may vary, which will be described with reference to FIGS. 17A and 17B.

Figure 17A:
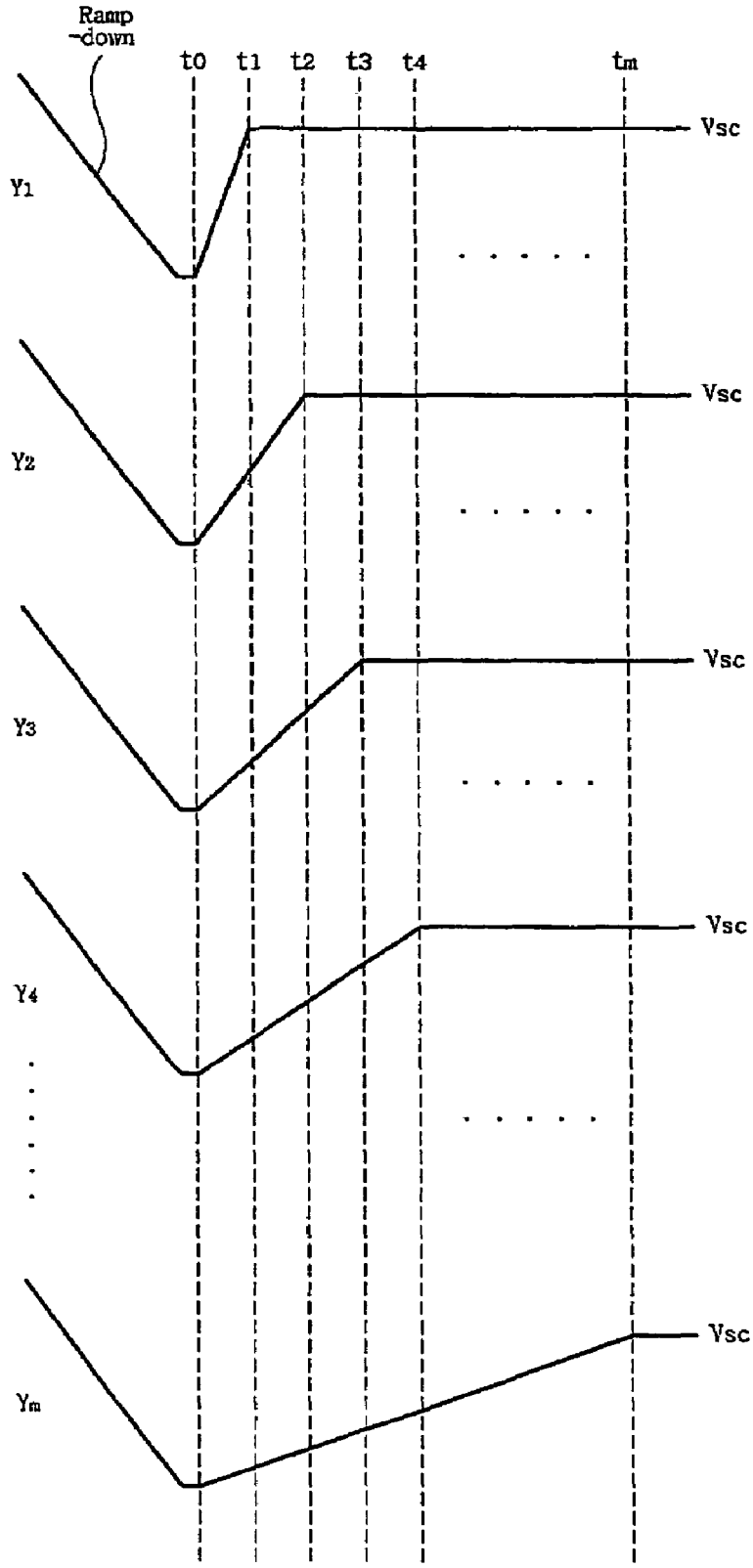
FIGS. 17A and 17B illustrates another example of changes in rising time of the scan reference voltage Vsc in accordance with the resistance values of the waveform generator.

First, referring to FIG. 17A, the rise time of the scan reference voltage Vsc supplied to the scan electrodes in the address period is controlled in accordance with the resistance values of the waveform generator of the apparatus for driving the PDP corresponding to the plurality of scan electrodes on the PDP.

For example, as illustrated in FIG. 17A, the scan reference voltage that starts to rise at the point of t0 and that reaches the scan reference voltage value Vsc at the point of t1 is supplied to the scan electrode Y1, the scan reference voltage that starts to rise at the point of t0 and that reaches the scan reference voltage value Vsc at the point of t2 is supplied to the scan electrode Y2, and the scan reference voltage that starts to rise at the point of t0 and that reaches the scan reference voltage value Vsc at the point of t3 is supplied to the scan electrode Y3.

As described above, the scan reference voltage that starts to rise at the point of t0 and that reaches the scan reference voltage value Vsc at the point of tm is supplied to the scan electrode Ym, which is achieved by the resistances of the waveform generator of the apparatus for driving the PDP.

This means that the resistance of the waveform generator corresponding to the scan electrode Y1, the resistance of the waveform generator corresponding to the scan electrode Y2, the resistance of the waveform generator corresponding to the scan electrode Y3, the resistance of the waveform generator corresponding to the scan electrode Y4, and the resistance of the waveform generator corresponding to the scan electrode Ym have different values.

In FIG. 17A, difference between the rise times of the scan reference voltage Vsc having different rise times is the same. However, as illustrated in FIG. 17B, difference between the rise times of the scan reference voltage Vsc having different rise times may vary.

Figure 17B:
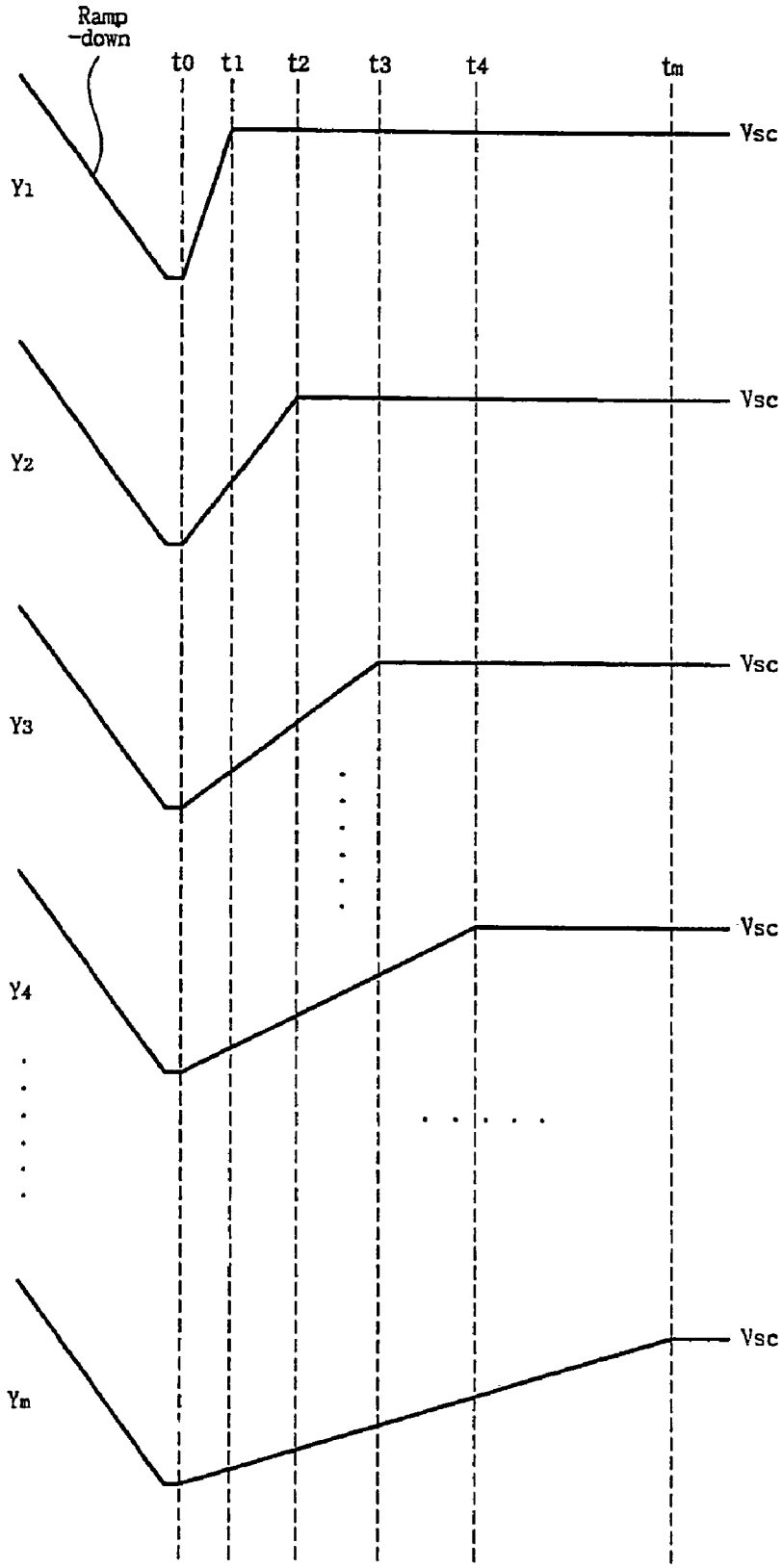

In FIGS. 17A and 17B, each of the plurality of scan electrode groups of FIGS. 16A and 16B comprises one scan electrode. Since the only difference between FIGS. 17A and 17B and FIGS. 16A and 16B is the number of scan electrodes comprised in a scan electrode group, redundant description will be omitted.

As described above, the apparatus for driving the PDP significantly reduces the magnitudes of the set up pulses supplied in the set up period of the reset period compared with the prior art so that the magnitude of the dark discharge generated in the reset period is reduced to improve contrast.

Also, it is possible to reduce the number of switching devices, that is, field effect transistors (FET) compared with the conventional driving apparatus and to reduce the magnitude of the set up voltage supplied in the set up period of the reset period so that it is possible to perform stable driving although the voltage withstand characteristic of the switching devices deteriorates compared with the prior art and to thus reduce the manufacturing cost of the apparatus for driving the PDP.

Also, the apparatus for driving the PDP makes the scan reference voltage Vsc supplied to the scan electrodes Y1 to Ym in the address period gradually rise with the slope to reduce the generation of the noise in the address period.

Exemplary embodiments of the invention having been thus described, it will be obvious that the same may be varied in many ways. Such variations are not to be regarded as a departure from the scope of the invention, and all such modifications as would be obvious to one skilled in the art are intended to be comprised within the scope of the claims.

What is claimed is:

1. A plasma display apparatus comprising:

a scan electrode;

a scan reference voltage supply part including a resistor unit arranged to apply, in an address period of a subfield, a scan rising waveform that gradually increases to a scan reference voltage with a second slope of a finite value, after a rising ramp waveform having a first slope and a falling ramp waveform are applied to the scan electrode in a reset period of the subfield; and a negative scan voltage supply part arranged to apply a negative scan pulse to the scan electrode in the address period, wherein the negative scan pulse is arranged to decrease from the scan reference voltage applied by the scan reference voltage supply part.

2. The plasma display apparatus of claim 1, wherein the resistor unit comprises a fixed resistor.

3. The plasma display apparatus of claim 1, wherein the scan reference voltage supply part is arranged to apply the scan reference voltage to the scan electrode after the scan reference voltage supply part applies the scan rising waveform to the scan electrode.

4. The plasma display apparatus of claim 1, further comprising a ramp waveform generating part arranged to apply a rising ramp waveform with a third slope different from the first slope at an ending point of the rising ramp waveform having the first slope.

5. The plasma display apparatus of claim 1, wherein the second slope of the scan rising waveform is less than a slope of a sustain pulse applied in a sustain period of the subfield.

6. The plasma display apparatus of claim 1, wherein the scan reference voltage supply part comprises a capacitor arranged to maintain the scan reference voltage at a constant voltage level.

7. The plasma display apparatus of claim 4, wherein the ramp waveform generating part comprises a resistor arranged to generate the rising ramp waveform with the third slope.

8. A plasma display apparatus comprising:

a scan electrode;

a scan reference voltage supply part including a resistor unit arranged to apply, in an address period of a subfield, a scan rising waveform that gradually increases to a scan reference voltage with a second slope of finite value, after a rising ramp waveform with a first slope is applied to the scan electrode in a reset period of the subfield; and a ramp waveform generating part arranged to apply, at an ending point of the rising ramp waveform with the first slope, a rising ramp waveform with a third slope different from the first slope of the rising ramp waveform applied by the scan reference voltage supply part.

9. The plasma display apparatus of claim 8, wherein the resistor unit is a fixed resistor.

10. The plasma display apparatus of claim 8, wherein the scan reference voltage supply part is arranged to apply the scan reference voltage to the scan electrode after the scan reference voltage supply part applies the scan rising waveform with the second slope to the scan electrode.

11. The plasma display apparatus of claim 8, wherein the second slope of the scan rising waveform is less than a slope of a sustain pulse applied in a sustain period of the subfield.

12. The plasma display apparatus of claim 8, wherein the scan reference voltage supply part comprises a capacitor arranged to maintain the scan reference voltage at a constant voltage level.

13. The plasma display apparatus of claim 8, wherein the ramp waveform generating part comprises a resistor arranged to generate the rising ramp waveform with the third slope.

14. The plasma display apparatus of claim 8, wherein the scan reference voltage supply part comprises a reverse current cutoff part.

15. The plasma display apparatus of claim 13, wherein the resistor comprises a variable resistor.

16. A plasma display apparatus comprising:

a scan electrode;

a scan reference voltage source arranged to supply a scan reference voltage to the scan electrode;

a scan drive integrated circuit provided between the scan electrode and the scan reference voltage source; and a ramp waveform supply unit provided between the scan reference voltage source and the scan drive integrated circuit, the ramp waveform supply unit including a resistor arranged in series with the scan reference voltage source and the scan drive integrated circuit, and the ramp waveform supply unit being adapted to apply, in an address period of a subfield, a scan rising waveform that gradually rises to the scan reference voltage with a finite slope.

17. The plasma display apparatus of claim 16, wherein the resistor is a fixed resistor.

18. The plasma display apparatus of claim 16, further comprising a switch provided between the scan reference voltage supply and the ramp waveform supply unit.

19. The plasma display apparatus of claim 1, wherein the scan rising waveform is applied at an ending point of the falling ramp waveform.

20. The plasma display apparatus of claim 8, wherein a falling ramp waveform is applied to the scan electrode in the reset period and the scan rising waveform is applied at an ending point of the falling ramp waveform.

* * * * *